US010124498B2

(12) United States Patent
Sablatschan

(10) Patent No.: US 10,124,498 B2
(45) Date of Patent: Nov. 13, 2018

(54) BLADE SET, HAIR CUTTING APPLIANCE, AND RELATED MANUFACTURING METHOD

(71) Applicant: KONINKLIJKE PHILIPS N.V., Eindhoven (NL)

(72) Inventor: Siegfried Sablatschan, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 6 days.

(21) Appl. No.: 15/303,842

(22) PCT Filed: Apr. 8, 2015

(86) PCT No.: PCT/EP2015/057537
§ 371 (c)(1),
(2) Date: Oct. 13, 2016

(87) PCT Pub. No.: WO2015/158572
PCT Pub. Date: Oct. 22, 2015

(65) Prior Publication Data

US 2017/0028576 A1 Feb. 2, 2017

(30) Foreign Application Priority Data

Apr. 18, 2014 (EP) ..... 14165281

(51) Int. Cl.
*B26B 19/38* (2006.01)
*B26B 19/04* (2006.01)

(52) U.S. Cl.
CPC ..... *B26B 19/3846* (2013.01); *B26B 19/042* (2013.01); *B26B 19/3893* (2013.01)

(58) Field of Classification Search
CPC ..... B26B 19/3846; B26B 19/042; B26B 19/3893
(Continued)

(56) References Cited

U.S. PATENT DOCUMENTS 2,102,529 A 12/1937 Hanley
2,216,797 A 10/1940 Andis
(Continued)

FOREIGN PATENT DOCUMENTS

DE 2455574 A1 7/1975
EP 0282117 A1 9/1988
(Continued)

*Primary Examiner* — Omar Flores Sanchez

(57) ABSTRACT

The present invention relates to a hair cutting appliance and to a blade set for a hair cutting appliance including a blade set having a stationary blade constructed having a first wall portion and a second wall portion that define therebetween a guide slot, a movable cutter blade received at the guide slot, and a transmitting member configured to be engaged by a driving member, and to actuate the movable cutter blade relative to the stationary blade, wherein the movable cutter blade is laterally inserted into the guide slot, wherein the transmitting member is fed to the stationary blade in a feed direction that is different from an insertion direction of the movable cutter blade, and wherein the transmitting member is coupled to a main portion of the movable cutter blade, such that the movable cutter blade is undetachably retained at the stationary blade. The disclosure further relates to a method for manufacturing a respective blade.

16 Claims, 10 Drawing Sheets

(58) Field of Classification Search
USPC ..... 30/50, 44, 60, 346.5
See application file for complete search history.

(56) References Cited

U.S. PATENT DOCUMENTS

| | | | | |
|---|---|---|---|---|
| 2011/0167639 | A1* | 7/2011 | Lau | B26B 19/06 30/34.1 |
| 2015/0183118 | A1* | 7/2015 | Roth | B26B 19/384 132/200 |
| 2017/0028576 | A1 | 2/2017 | Sablatschan | |
| 2017/0144319 | A1* | 5/2017 | Sablatschan | B26B 19/3846 |

FOREIGN PATENT DOCUMENTS

| | | | |
|---|---|---|---|
| EP | 1894685 | A1 | 3/2008 |
| GB | 501137 | A | 2/1939 |
| GB | 119005 | A | 11/1954 |
| GB | 2425277 | A | 10/2006 |
| JP | 5492455 | | 7/1979 |
| JP | 2003181164 | A | 7/2003 |
| WO | 2007125491 | A1 | 11/2007 |
| WO | 2009149662 | A1 | 12/2009 |
| WO | 2013150412 | A1 | 10/2013 |

* cited by examiner

BLADE SET, HAIR CUTTING APPLIANCE, AND RELATED MANUFACTURING METHOD

This application is the U.S. National Phase application under 35 U.S.C. § 371 of International Application No. PCT/EP2015/057537, filed on Apr. 8, 2015, which claims the benefit of International Application No. 14165281.8 filed on Apr. 18, 2014. These applications are hereby incorporated by reference herein.

FIELD OF THE INVENTION

The present disclosure relates to a hair cutting appliance, particularly to an electrically operated hair cutting appliance, and more particularly to a blade set for such an appliance. The blade set may be arranged to be moved through hair in a moving direction to cut hair. The blade set may comprise a stationary blade composed of a first wall portion and a second wall portion that define therebetween a guide slot, where a movable cutter blade may be at least partially encompassed and guided. The movable cutter may be actuated with respect to the stationary blade to cut hair. The present disclosure further relates to a method for manufacturing a blade set for a hair cutting appliance.

BACKGROUND OF THE INVENTION

WO 2013/150412 A1 discloses a hair cutting appliance and a corresponding blade set of a hair cutting appliance. The blade set comprises a stationary blade and a movable blade, wherein the movable blade can be reciprocatingly driven with respect to the stationary blade for cutting hair. The blade set is particularly suited for enabling both trimming and shaving operations.

GB 719,005 A discloses a hair clipper of the type comprising a fixed comb member of substantially tubular shape, a movable comb member also of substantially tubular shape, slidably located in said fixed member, the cutting portion of said fixed and movable comb members being formed by two cooperating straight surfaces forming an acute angle, said fixed comb member comprising moreover at its vertex or edge portion a non-cutting projection acting as a guiding comb or forecomb for the hair before the same is cut by the apparatus.

For the purpose of cutting body hair, there exist basically two customarily distinguished types of electrically powered appliances: the razor, and the hair trimmer or clipper. Generally, the razor is used for shaving, i.e. slicing body hairs at the level of the skin so as to obtain a smooth skin without stubbles. The hair trimmer is typically used to sever the hairs at a chosen distance from the skin, i.e. for cutting the hairs to a desired length. The difference in application is reflected in the different structure and architectures of the cutting blade arrangement implemented on either appliance.

An electric razor typically includes a foil, i.e. an ultra-thin perforated screen, and a cutter blade that is movable along the inside of and with respect to the foil. During use, the outside of the foil is placed and pushed against the skin, such that any hairs that penetrate the foil are cut off by the cutter blade that moves with respect to the inside thereof, and fall into hollow hair collection portions inside the razor.

An electric hair trimmer, on the other hand, typically includes generally two cutter blades having a toothed edge, one placed on top of the other such that the respective toothed edges overlap. In operation, the cutter blades reciprocate relative to each other, cutting off any hairs that are trapped between their teeth in a scissor action. The precise level above the skin at which the hairs are cut off is normally determined by means of an additional attachable part, called a (spacer) guard or comb.

Furthermore, combined devices are known that are basically adapted to both shaving and trimming purposes. However, these devices merely include two separate and distinct cutting sections, namely a shaving section comprising a setup that matches the concept of powered razors as set out above, and a trimming section comprising a setup that, on the other hand, matches the concept of hair trimmers.

Common electric razors are not particularly suited for cutting hair to a desired variable length above the skin, i.e., for precise trimming operations. This can be explained, at least in part, by the fact that they do not include mechanisms for spacing the foil and, consequently, the cutter blade from the skin. But even if they did, e.g. by adding attachment spacer parts, such as spacing combs, the configuration of the foil, which typically involves a large number of small perforations, would diminish the efficient capture of all but the shortest and stiffest of hairs.

Similarly, common hair trimmers are not particularly suited for shaving, primarily because the separate cutter blades require a certain rigidity, and therefore thickness, to perform the scissor action without deforming. It is the minimum required blade thickness of a skin-facing blade thereof that prevents hair from being cut off close to the skin. Consequently, a user desiring to both shave and trim his/her body hair may need to purchase and apply two separate appliances.

Furthermore, combined shaving and trimming devices show several drawbacks since they basically require two cutting blade sets and respective drive mechanisms. Consequently, these devices are heavier and more susceptible to wear than standard type single-purpose hair cutting appliances, and also require costly manufacturing and assembling processes. Similarly, operating these combined devices is often experienced to be rather uncomfortable and complex. Even in case a conventional combined shaving and trimming device comprising two separate cutting sections is utilized, handling the device and switching between different operation modes may be considered as being time-consuming and not very user-friendly. Since the cutting sections are typically provided at different locations of the device, guidance accuracy (and therefore also cutting accuracy) may be reduced, as the user needs to get used to two distinct dominant holding positions during operation.

The above WO 2013/150412 A1 tackles some of these issues by providing a blade set comprising a stationary blade that houses the movable blade such that a first portion of the stationary blade is arranged at the side of the movable blade facing the skin, when used for shaving, and that a second portion of the stationary blade is arranged at the side of the movable blade facing away from the skin when in use. Furthermore, at a toothed cutting edge, the first portion and the second portion of the stationary blade are connected, thereby forming a plurality of stationary teeth that cover respective teeth of the movable blade. Consequently, the movable blade is guarded by the stationary blade.

This arrangement is advantageous insofar as the stationary blade may provide the blade set with increased strength and stiffness since the stationary blade is also present at the side of the movable blade facing away from the skin. This may generally enable a reduction of the thickness of the first portion of the stationary blade at the skin-facing side of the movable blade. Consequently, since in this way the movable blade may come closer to the skin during operation, the above blade set is well-suited for hair shaving operations. Aside from that, the blade set is also particularly suited for hair trimming operations since the configuration of the cutting edge, including respective teeth alternating with slots, also allows longer hairs to enter the slots and, consequently, to be cut by the relative cutting motion between the movable blade and the stationary blade.

However, there is still a need for improvement in hair cutting devices and respective blade sets. This may particularly involve user comfort related aspects, performance related aspects, and manufacturing related aspects. Manufacturing related aspects may involve suitability for series production or mass production and assembly cost reduction.

SUMMARY OF THE INVENTION

It is an object of the present disclosure to provide an alternative blade set that enables both shaving and trimming. In particular, a blade set may be provided that contributes to a pleasant user experience in both shaving and trimming operations. More preferably, the present disclosure may address at least some drawbacks inherent in known prior art hair cutting blades, as discussed above, for instance. It would be further advantageous to provide a blade set that may exhibit an improved operating performance while preferably reducing the time required for cutting operations. It is further preferred to provide a corresponding method for manufacturing such a blade. It is particularly desired to present a manufacturing method that may permit the production of blade sets and particularly of stationary blades in a cost-efficient manner and, more preferably, with a minimized number of components.

In a first aspect of the present disclosure a blade set for a hair cutting appliance is presented, said blade set being arranged to be moved through hair in a moving direction to cut hair, said blade set comprising:

a stationary blade comprising a first wall portion arranged to serve as a skin facing wall when in operation, a second wall portion at least partially offset from the first wall portion, such that the first wall portion and the second wall portion define therebetween a guide slot arranged to receive a movable cutter blade, and at least one toothed leading edge jointly formed by the first wall portion and the second wall portion, and a movable cutter blade comprising at least one toothed leading edge, said movable cutter blade being movably arranged within the guide slot defined by the stationary blade such that, upon relative motion of the movable cutter blade with respect to the stationary blade, the at least one toothed leading edge of the movable cutter blade cooperates with corresponding teeth of the stationary blade to enable cutting of hair caught therebetween in a cutting action, a transmitting member configured to be engaged by a driving member; wherein the transmitting member is further configured to actuate the movable cutter blade relative to the stationary blade, wherein the movable cutter blade is laterally inserted into the guide slot, wherein the transmitting member is fed to the stationary blade in a feed direction that is different from an insertion direction of the movable cutter blade, and wherein the transmitting member is coupled to the movable cutter blade, particularly to a main portion thereof, such that the movable cutter blade is secured at the stationary blade, particularly undetachably retained, and wherein the movable cutter blade, particularly a main sheet metal portion thereof, and the transmitting member jointly embrace a retaining tab, particularly a laterally extending retaining tab, of the second wall portion of the stationary blade.

This aspect is based on the insight that the movable cutter blade may be mounted to the stationary blade in a loss-proof manner without the need of adding further distinct securing elements. This may be achieved even though the movable blade can be inserted into the guide slot which may basically imply that the movable cutter blade may be released or removed in the same manner. Locking or securing the movable cutter blade may be achieved as a result from connecting the movable cutter blade and the transmitting member. Consequently, also the transmitting member may be secured at the stationary blade. The movable cutter blade and the transmitting member may jointly form a securing arrangement that cooperates with the stationary blade. It is particularly preferred that the movable cutter blade is captively retained at the stationary blade. As a result of the difference between the insertion direction and the feed direction, the transmitting member may engage the movable cutter blade and, consequently, lock the movable cutter blade against dropping out in the insertion direction.

As used herein, relative motion between the movable cutter blade and the stationary blade may involve reciprocating motion of the movable cutter blade with respect to the stationary blade. In some embodiments, relative motion may involve rotation of the movable blade with respect to the cutter blade.

In one embodiment, the movable cutter blade is inserted into the stationary blade in a lateral direction Y, wherein the transmitting member is fed in a vertical direction Z that is basically perpendicular to the lateral direction Y, and wherein the movable cutter blade is mounted at the stationary blade in a laterally movable manner. Hence, the insertion direction of the movable cutter blade may basically correspond to a main direction of the cutting motion. Generally, the movable cutter blade may be secured against disengagement in the vertical direction Z in the guide slot of stationary blade. In other words, the movable cutter blade basically cannot be lifted from the first wall portion since the second wall portion may block the movable cutter blade.

In one embodiment, the movable cutter blade, particularly a main sheet metal portion thereof, and the transmitting member jointly embrace a retaining tab, particularly a laterally extending retaining tab, of the second wall portion of the stationary blade. This may involve that the movable cutter blade and the transmitting member jointly form a securing loop that entirely encircles the retaining tab. However, in some embodiments, the movable cutter blade and the transmitting member jointly form a positive lock securing arrangement that does not entirely surround the retaining tab. By way of example, the transmitting member may extend in the vertical direction Z through an opening in the retaining tab.

In one embodiment, the movable cutter blade and the transmitting member jointly define a securing opening, and wherein the retaining tab of the stationary blade is located in the securing opening. Consequently, the movable cutter blade and the transmitting member jointly define a first securing loop that engages a further second loop that is formed from a cross-sectional loop profile of the stationary blade. The first securing loop and the second securing loop may be arranged similar to engaged chain links.

In one embodiment, the second wall portion of the stationary blade, particularly the retaining tab thereof, defines a lateral limit stop for the movable cutter blade. Hence, the movable cutter blade may be driven in the guide slot in a reciprocating manner. The lateral limit stop may limit the allowed motion path of the movable cutter blade in the lateral direction Y. The transmitting member may be arranged to contact the limit stop upon lateral motion. Since the movable cutter blade, when coupled with the transmitting member, cannot surmount the lateral limit stop, a dropping-out of the movable blade can be avoided. Consequently, the lateral motion of the movable cutter blade may be limited by the transmitting member and the stationary blade in an indirect manner.

In one embodiment, the second wall portion of the stationary blade, particularly at least one guide element thereof, defines a longitudinal position of the movable cutter blade with respect to the stationary blade. Hence, the movable cutter blade may be received in a defined manner without the need of adding further mounting and alignment elements. By way of example, the lateral position (X-position) of the movable cutter blade may be defined by the transmitting member and the stationary blade in an indirect manner. Preferably, a plurality of guide elements is provided that in contact with the transmitting member at oppositely facing sides thereof. In an alternative example, the lateral position (X-position) of the movable cutter blade with respect to the stationary blade may be defined in a direct manner by directly contacting the at least one guide element with the movable cutter blade.

In one embodiment, the movable cutter blade and the transmitting member are bonded to each other in the mounted state. Bonding may involve welding, soldering, laser bonding, particularly laser welding etc. It may be therefore preferred that the movable cutter blade and the transmitting member are at last partially made from metal material, at least at their bonding spots. However, it may be also envisaged produce at least one of the movable cutter blade and the transmitting member of a non-metal material, e.g. of plastic material. Also plastic materials may be bonded. Also plastic materials and metal materials may be bonded, e.g. by gluing.

In one embodiment, the movable cutter blade and the transmitting member are positively locked to each other in the mounted state. This may involve plugging the transmitting member to the movable blade. Attaching the movable cutter blade to the stationary blade in a positive fit manner may include coupling the movable cutter blade and the stationary blade in a snap-on manner. Attaching the movable cutter blade to the stationary blade in a positive fit manner may further include attaching the transmitting member at the stationary blade in a positive fit manner. By way of example, the transmitting member may be coupled to the movable blade for laterally driving the movable blade. Further, the transmitting member may be locked at the stationary blade for preventing a vertical release motion of the transmitting member. The transmitting member may be formed from plastic material, for instance. Plastic material may facilitate the formation of snap-on elements at the transmitting member.

In one embodiment, the first wall portion and the second wall portion enable a defined clearance fit mating of the movable cutter blade in the guide slot of the stationary blade. This may further reduce the required number of distinct, separate components for the blade set.

In one embodiment, the stationary blade is an integrally formed metal-plastic composite stationary blade, wherein the first wall portion is at least partially made from metal material, wherein the second wall portion is at least partially made from plastic material, wherein the at least one toothed leading edge of the stationary blade comprises a plurality of teeth, and wherein the first wall portion and the second wall portion are connected at a frontal end of the at least one leading edge, thereby forming tips of the teeth. This may have the advantage that the first wall portion my be significantly thin, resulting in an improved shaving performance.

In one embodiment, the stationary blade comprises a metal component, particularly a sheet metal insert, and a plastic component bonded to the metal component, wherein at least a central portion of the first wall portion is formed by the metal component, wherein the plastic component and the metal component form an integrally formed part selected from the group consisting of insert-molded part, outsert-molded part and overmolded part. This may further reduce overall manufacturing time and costs.

In a further aspect of the present disclosure a hair cutting appliance, particularly an electrically powered hair cutting appliance, is presented, said hair cutting cutting appliance being arranged to be moved through hair in a moving direction to cut hair, said hair cutting appliance comprising a cutting head that is fitted with a blade set in accordance with at least some embodiments as disclosed herein.

In a further aspect of the present disclosure a method of manufacturing a blade set for a hair cutting appliance is presented, said method comprising the following steps:

- providing a stationary blade comprising at least one toothed leading edge, the stationary blade further comprising a first wall portion and a second wall portion, wherein the second wall portion is at least partially offset from the first wall portion, such that the first wall portion and the second wall portion define therebetween a guide slot arranged to receive a movable cutter blade
- providing a movable cutter blade comprising at least one toothed leading edge,
- inserting the movable cutter blade into the guide slot of the stationary blade, particularly passing the movable cutting blade through a lateral opening of the stationary blade
- providing a transmitting member configured to be engaged by a driving member, wherein the transmitting member is further configured to actuate the movable cutter blade for relative motion with respect to the stationary blade,
- with the movable cutter blade inserted, feeding the transmitting member to the stationary blade, particularly feeding the transmitting member in a feed direction that is different from an insertion direction of the movable cutter blade,
- mounting the movable cutter blade to the stationary blade, comprising connecting the transmitting member to the movable cutter blade, particularly to a main portion thereof, thereby locking the transmitting member to the movable cutter blade such that the movable cutter blade is retained at the stationary blade, wherein the movable cutter blade, particularly the main portion thereof, and the transmitting member jointly embrace a retaining tab, particularly a laterally extending retaining tab, of the second wall portion of the stationary blade.

The movable cutter blade may be received at the stationary blade in an undetachable, loss proof manner. Preferably, the movable cutter blade is captively retained at the stationary blade.

In one embodiment of the method, the step of inserting the movable cutter blade may further comprise inserting the movable cutter blade in a lateral direction Y, and wherein the step of feeding the transmitting member comprises feeding the transmitting member in a vertical direction Z that is basically perpendicular to the lateral direction Y.

In one embodiment of the method, the movable cutter blade is mounted at the stationary blade in a laterally movable manner, and wherein the movable cutter blade is secured against disengagement in the vertical direction Z. It is preferred that the movable cutter blade is slidably received at the guide slot. It is further preferred that the movable cutter blade is arranged for reciprocating linear motion with respect to the stationary blade.

In one embodiment of the method, the step of mounting the movable cutter blade to the stationary blade may further comprise:

with the movable cutter blade inserted into the guide slot, locking the transmitting member and the movable cutter blade in a positive-locking manner, particularly engaging an engagement portion at the movable cutter blade.

In one embodiment of the method, the step of mounting the movable cutter blade to the stationary blade may further comprise:

with the movable cutter blade inserted into the guide slot, bonding the transmitting member to the movable cutter blade.

In one embodiment of the method, the step of bonding may further comprise:

with the movable cutter blade inserted into the guide slot, laterally moving the movable cutter blade with respect to the stationary blade such that a lateral end portion of the movable cutter blade is accessible for a bonding device, aligning the transmitting member and the movable cutter blade such that respective bonding spots overlap each other, and bonding the transmitting member to the movable cutter blade.

In still another embodiment, the step of bonding may be accomplished by retracting the movable cutter blade into a centered position, laterally moving the movable cutter blade in the opposite direction with respect to the stationary blade such that a further lateral end portion of the movable cutter blade is accessible for a bonding device, and bonding the transmitting member to the movable cutter blade. Consequently, at least two bonding spots at opposite lateral ends of the movable cutter blade may be formed.

In another, more general aspect of the present disclosure, blade set for a hair cutting appliance is presented, said blade set being arranged to be moved through hair in a moving direction to cut hair, said blade set comprising:

a stationary blade comprising a first wall portion arranged to serve as a skin facing wall when in operation, a second wall portion at least partially offset from the first wall portion, such that the first wall portion and the second wall portion define therebetween a guide slot arranged to receive a movable cutter blade, and at least one toothed leading edge jointly formed by the first wall portion and the second wall portion, and a movable cutter blade comprising at least one toothed leading edge, said movable cutter blade being movably arranged within the guide slot defined by the stationary blade such that, upon relative motion of the movable cutter blade with respect to the stationary blade, the at least one toothed leading edge of the movable cutter blade cooperates with corresponding teeth of the stationary blade to enable cutting of hair caught therebetween in a cutting action, a transmitting member configured to be engaged by a driving member, wherein the transmitting member is further configured to actuate the movable cutter blade relative to the stationary blade, wherein the movable cutter blade is laterally inserted into the guide slot, wherein the transmitting member is fed to the stationary blade in a feed direction that is different from an insertion direction of the movable cutter blade, and wherein the transmitting member is coupled to the movable cutter blade, particularly to a main portion thereof, such that the movable cutter blade is secured at the stationary blade, particularly undetachably retained.

It is worth mentioning that this aspect may form part of a separate invention and may be therefore implemented in isolation and/or in combination with any of the embodiments and refinements as discussed herein.

In yet another, more general aspect of the present disclosure, a method of manufacturing a blade set for a hair cutting appliance is presented, said method comprising the following steps:

providing a stationary blade comprising at least one toothed leading edge, the stationary blade further comprising a first wall portion and a second wall portion, wherein the second wall portion is at least partially offset from the first wall portion, such that the first wall portion and the second wall portion define therebetween a guide slot arranged to receive a movable cutter blade providing a movable cutter blade comprising at least one toothed leading edge, inserting the movable cutter blade into the guide slot of the stationary blade, particularly passing the movable cutting blade through a lateral opening of the stationary blade providing a transmitting member configured to be engaged by a driving member, wherein the transmitting member is further configured to actuate the movable cutter blade for relative motion with respect to the stationary blade, with the movable cutter blade inserted, feeding the transmitting member to the stationary blade, particularly feeding the transmitting member in a feed direction that is different from an insertion direction of the movable cutter blade, mounting the movable cutter blade to the stationary blade, comprising connecting the transmitting member to the movable cutter blade, particularly to a main portion thereof, thereby locking the transmitting member to the movable cutter blade such that the movable cutter blade is retained at the stationary blade.

It is worth mentioning that this aspect may form part of a separate invention and may be therefore implemented in isolation and/or in combination with any of the embodiments and refinements as discussed herein.

Preferred embodiments of the invention are defined in the dependent claims. It shall be understood that the claimed method has similar and/or identical preferred embodiments as the claimed device and as defined in the dependent claims.

BRIEF DESCRIPTION OF THE DRAWINGS

These and other aspects of the invention will be apparent from and elucidated with reference to the embodiments described hereinafter. In the following drawings

DETAILED DESCRIPTION OF THE INVENTION

Figure 1:
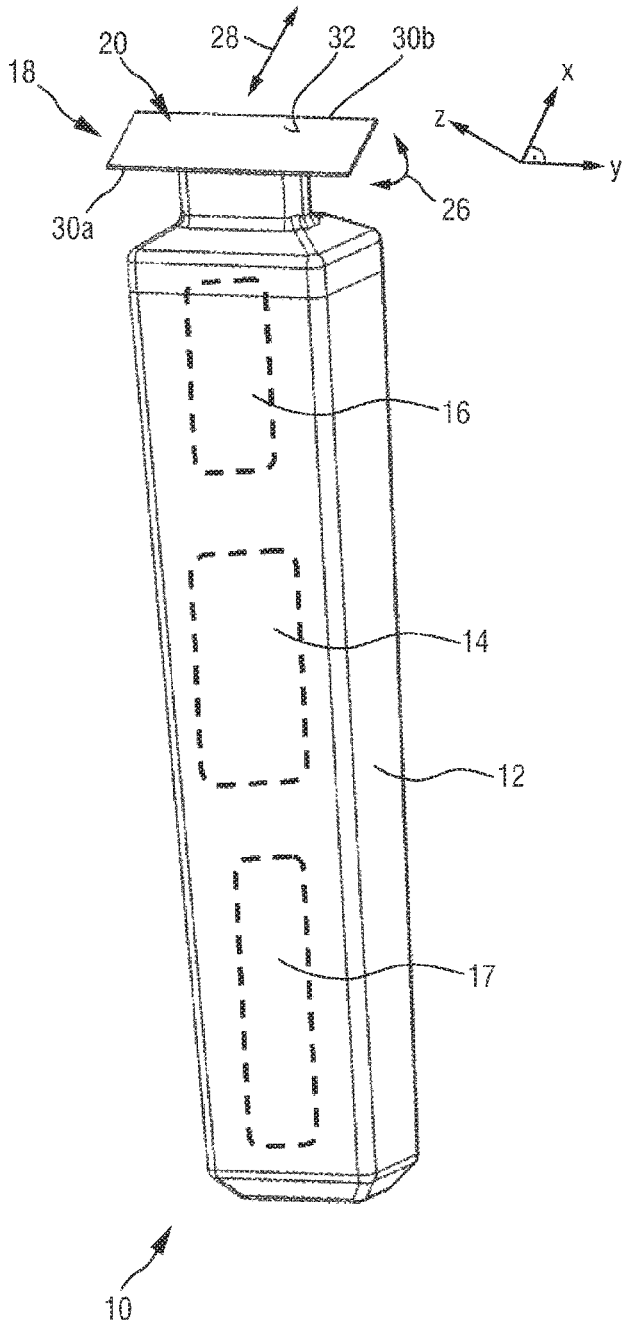
FIG. 1 shows a schematic perspective view of an exemplary electric hair cutting appliance fitted with an exemplary embodiment of a blade set in accordance with the present disclosure.

FIG. 1 schematically illustrates, in a simplified perspective view, an exemplary embodiment of a hair cutting appliance 10, particularly an electric hair cutting appliance 10. The cutting appliance 10 may comprise a housing 12, a motor indicated by a dashed block 14 in the housing 12, and a drive mechanism or drivetrain indicated by a dashed block 16 in a housing 12. For powering the motor 14, at least in some embodiments of the cutting appliance 10, an electrical battery, indicated by a dashed block 17 in the housing 12, may be provided, such as, for instance, a rechargeable battery, a replaceable battery, etc. However, in some embodiments, the cutting appliance 10 may be further provided with a power cable for connecting a power supply. A power supply connector may be provided in addition or in the alternative to the (internal) electric battery 17.

The cutting appliance 10 may further comprise a cutting head 18. At the cutting head 18, a blade set 20 may be attached to the hair cutting appliance 10. The blade set 20 may be driven by the motor 14 via the drive mechanism or drivetrain 16 to enable a cutting motion. The cutting motion may generally be regarded as a relative motion between a stationary blade 22 and a movable blade 24 which are shown and illustrated in more detail in FIG. 3, for instance, and will be described and discussed hereinafter. Generally, a user may grasp, hold and manually guide the cutting appliance 10 through hair in a moving direction 28 to cut hair. The cutting appliance 10 may be generally regarded as a hand-guided and hand-operated electrically powered device. Furthermore, the cutting head 18 or, more particularly, the blade set 20 can be connected to the housing 12 of the cutting appliance 10 in a pivotable manner, refer to the curved double-arrow indicated by reference numeral 26 in FIG. 1. In some embodiments, the cutting appliance 10 or, more specifically, the cutting head 18 including the blade set 20 can be moved along skin to cut hair growing at the skin. When cutting hair closely to the skin, basically a shaving operation can be performed aiming at cutting or chopping hair at the level of the skin. However, also clipping (or trimming) operations may be envisaged, wherein the cutting head 18 comprising the blade set 20 is passed along a path at a desired distance relative to the skin.

When being guided moved through hair, the cutting appliance 10 including the blade set 20 is typically moved along a common moving direction which is indicated by the reference numeral 28 in FIG. 1. It is worth mentioning in this connection that, given that the hair cutting appliance 10 is typically manually guided and moved, the moving direction 28 thus not necessarily has to be construed as a precise geometric reference having a fixed definition and relation with respect to the orientation of the hair cutting appliance 10 and its cutting head 18 fitted with the blade set 20. That is, an overall orientation of the hair cutting appliance 10 with respect of the to-be-cut hair at the skin may be construed as somewhat unsteady. However, for illustrative purposes, it may be fairly assumed that the (imaginary) moving direction 28 is parallel (or generally parallel) to a main central plane of a coordinate system which may serve in the following as a means for describing structural features of the hair cutting appliance 10.

For ease of reference, coordinate systems are indicated in several drawings herein. By way of example, a Cartesian coordinate system X-Y-Z is indicated in FIG. 1. An axis X of the respective coordinate system extends in a generally longitudinal direction that is generally associated with length, for the purpose of this disclosure. An axis Y of the coordinate system extends in a lateral (or transverse) direction associated with width, for the purpose of this disclosure. An axis Z of the coordinate system extends in a height (or vertical) direction which may be referred to for illustrative purposes, at least in some embodiments, as a generally vertical direction. It goes without saying that an association of the coordinate system X-Y-Z to characteristic features and/or embodiments of the hair cutting appliance 10 is primarily provided for illustrative purposes and shall not be construed in a limiting way. It should be understood that those skilled in the art may readily convert and/or transfer the coordinate system provided herein when being confronted with alternative embodiments, respective figures and illustrations including different orientations. It is further worth mentioning that, for the purpose of the present disclosure, the coordinate system X-Y-Z is generally aligned with main directions and orientations of the cutting head 18 including the blade set 20.

Figure 2:
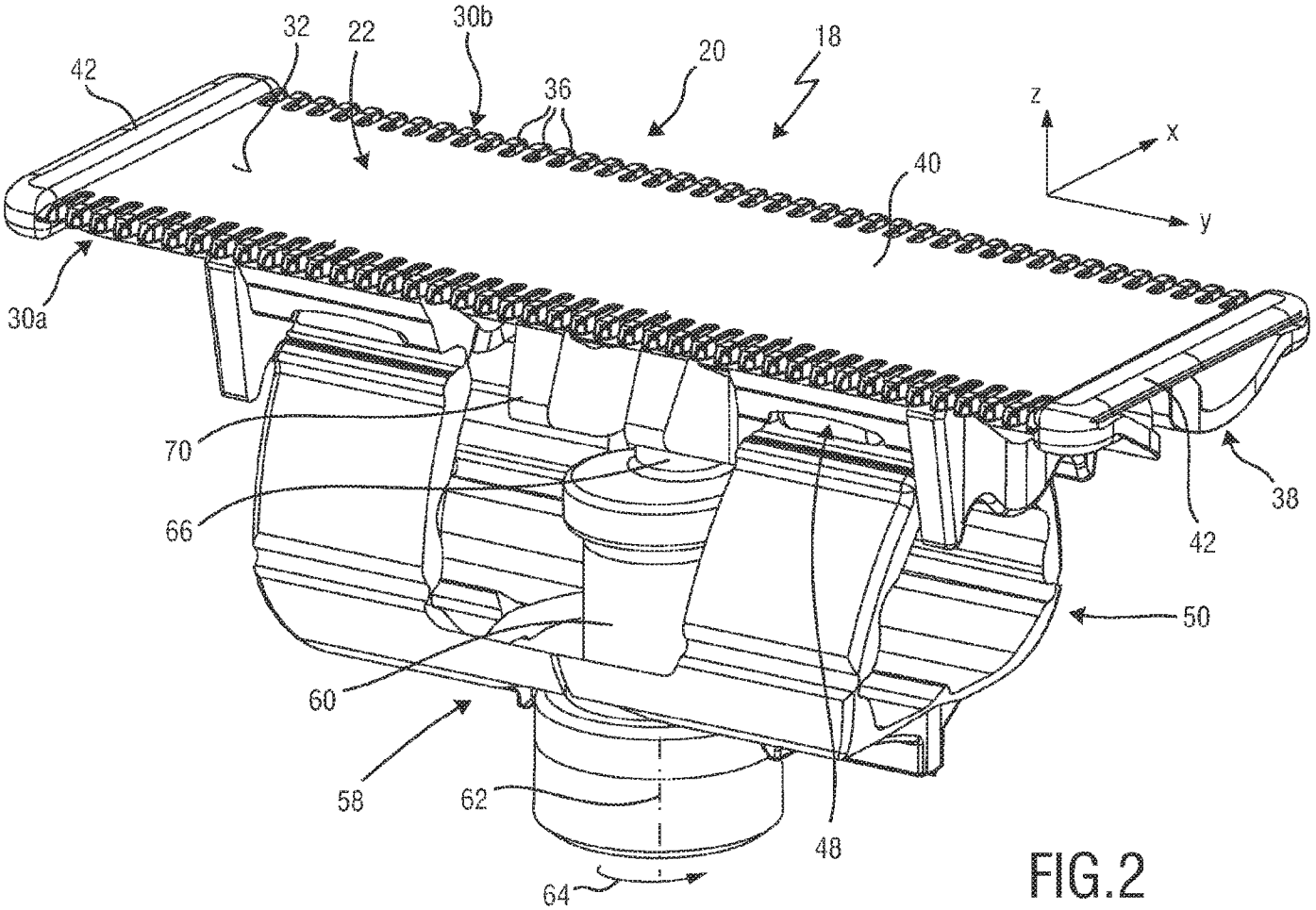
FIG. 2 shows a schematic top view of a cutting head comprising a blade set in accordance with the present disclosure, the cutting head being attached to a linkage mechanism.

FIG. 2 illustrates a perspective top view of an exemplary embodiment of the cutting head 18 that may be attached to the hair cutting appliance as shown in FIG. 1. The cutting head 18 is provided with the blade set 20 as already indicated above. The blade set 20 comprises a stationary blade 22 and a movable cutter blade 24 (hidden in FIG. 2). Further reference is made in this connection to the exploded view of the blade set 20 shown in FIG. 3. The stationary blade 22 and the movable cutter blade 24 are configured to be moved with respect to each other, thereby cutting hairs at their respective cutting edges.

The stationary blade 22 further comprises a top surface 32 which may be regarded as a skin-facing surface. Typically, when in operation as a shaving device, the hair cutting appliance 10 is oriented in such a way that the top surface 32 is basically parallel to or slightly inclined with respect to the skin. However, also alternative operation modes may be envisaged, where the top surface 32 is not necessarily parallel or, at least, substantially parallel to the skin. For instance, the hair cutting appliance 10 may be further used for beard styling or, more generally, hair styling. Hair styling may aim at the processing of considerably sharp edges or transitions between differently treated hair portions or beard portions of the user. By way of example, hair styling may involve precise shaping of sideburns or further distinct patches of facial hair. Consequently, when used in a styling mode, the top surface 32 and the currently to-be-treated skin portion are arranged at an angle, particularly substantially perpendicular to each other.

However, primarily for illustrative purposes, the top surface 32 and similarly oriented portions and components of the hair cutting appliance 10 may be regarded as skin-facing components and portions hereinafter. Consequently, elements and portions that are oriented in an opposite manner may be regarded as rearwardly oriented elements and portions or rather as elements and portions facing away from the skin hereinafter, for the purpose of disclosure.

As already indicated above, the stationary blade 22 may define at least one toothed leading edge 30. As shown in FIG. 2, the stationary blade 22 may define a first leading edge 30*a* and a second leading edge 30*b* that are offset from each other in the longitudinal direction X. The at least one toothed leading edge 30*a*, 30*b* may generally extend in the lateral direction Y. The top surface 32 may be regarded as a surface that is generally parallel to a plane defined by the longitudinal direction X and the lateral direction Y. At the at least one toothed leading edge 30, a plurality of teeth 36 of the stationary blade 22 may be provided. The teeth 36 may alternate with respective teeth slots. The teeth slots may define gaps between the teeth 36. Hairs may enter the gaps when the hair cutting appliance 10 is moved through hair in the moving direction 28 (FIG. 1).

The stationary blade 22 may be arranged as a metal-plastic composite component, for instance. In other words, the stationary blade 22 may be obtained from a multi-step manufacturing method that may include providing a metal component 40 (see also FIG. 3) and forming or, more precisely, molding a plastic component 38 including bonding the metal component 40 and the plastic component 38. This may particularly involve forming the stationary blade 22 by an insert-molding process, outsert-molding process or by an overmolding process. Generally, the stationary blade 22 may be regarded as a two-component stationary blade 22. However, since the stationary blade 22 is preferably formed by an integrated manufacturing process, basically no conventional assembly steps are required when forming the stationary blade 22. Rather, the integrated manufacturing process may include a net-shape manufacturing step or, at least, a near-net-shape manufacturing process. By way of example, molding the plastic component 38 which may also include bonding the plastic component 38 to the metal component 40 may readily define a near-net-shape or a net-shape configuration of the stationary blade 22. It is particularly preferred that the metal component 40 is made from sheet metal. It is particularly preferred that the plastic component 38 is made from injection-moldable plastic material.

Forming the stationary blade 22 from of different components, particularly integrally forming the stationary blade 22 may further have the advantage that portions thereof that have to endure high loads during operation may be formed from respective high-strength materials (e.g. metal materials) while portions thereof that are generally not exposed to huge loads when in operation may be formed from different materials which may significantly reduce manufacturing costs. Forming the stationary blade 22 as a plastic-metal composite part may further have the advantage that skin contact may be experienced by the user as being more comfortable. Particularly the plastic component 38 may exhibit a greatly reduced thermal conductivity when compared with the metal component 40. Consequently, heat emission sensed by the user when cutting hair may be reduced. In conventional hair cutting appliances, heat generation may be regarded as a huge barrier for improving the cutting performance. Heat generation basically limits the power and/or cutting speed of hair cutting appliances. By adding basically heat insulating materials (e.g. plastic materials) heat transfer from heat-generating spots (e.g. cutting edges) to the user's skin may be greatly reduced. This applies in particular at the tips of the teeth 36 of the stationary blade 22 which may be formed of plastic material.

Forming the stationary blade 22 as an integrally formed metal-plastic composite part may further have the advantage that further functions may be integrated in the design of the stationary blade 22. In other words, the stationary blade 22 may provide an enhanced functionality without the need of attaching or mounting additional components thereto.

By way of example, the plastic component 38 of the stationary blade 22 may be fitted with lateral protecting elements 42 which may also be regarded as so-called lateral side protectors. The lateral protecting elements 42 may cover lateral ends of the stationary blade 22, refer also to FIGS. 3 and 10. Consequently, direct skin contact at the relatively sharp lateral ends of the metal component 40 can be prevented. This may be particularly beneficial since the metal component 40 of the stationary blade 22 is relatively thin so as to allow to cut hairs close to the skin when shaving. However, at the same time, the relatively thin arrangement of the metal component 40 might cause skin irritation when sliding on the skin surface during shaving. Since particularly the skin-contacting portion of the metal component 40 may be actually so thin that relatively sharp edges may remain, the risk of skin irritations or even skin cuts may be the higher the thinner the metal component 40 and the stationary blade 22 actually is. It is therefore preferred, at least in some embodiments, to shield lateral sides of the metal component 40. The lateral protecting elements 42 may protrude from the top surface in the vertical direction or height direction Z. The at least one lateral protecting element 42 may be formed as an integrated part of the plastic component 38.

The stationary blade 22 may be further provided with mounting elements 48 that may enable a quick attachment to and a quick release from a linkage mechanism 50. The mounting elements 48 may be arranged at the plastic component 38, particularly integrally formed with the plastic component 38, refer also to FIGS. 3 and 10. The mounting elements 48 may comprise mounting protrusions, particularly snap-on mounting elements. The mounting elements 48 may be configured to cooperate with respective mounting elements at the linkage mechanism 50. It is particularly preferred that the blade set 20 can be attached to the linkage mechanism 50 without any further separate attachment member.

The linkage mechanism 50 (refer to FIG. 2) may connect the blade set 20 and the housing 12 of the hair cutting appliance 10. The linkage mechanism 50 may be configured such that the blade set 20 may swivel or pivot during operation when being guided through hair. The linkage mechanism 50 may provide the blade set 20 with a contour following capability. In some embodiments, the linkage mechanism 50 is arranged as a four-bar linkage mechanism. This may allow for a defined swiveling characteristic of the blade set 20. The linkage mechanism 50 may define a virtual pivot axis for the blade set 20.

FIG. 2 further illustrates an eccentric coupling mechanism 58. The eccentric coupling mechanism 58 may be regarded as a part of the drive mechanism or drivetrain 16 of the hair cutting appliance 10. The eccentric coupling mechanism 58 may be arranged to transform a rotational driving motion, refer to a curved arrow indicated by reference numeral 64 in FIG. 2, into a reciprocating motion of the movable blade 24 with respect to the stationary blade 22, refer also to FIG. 12 in this connection (double-arrow denoted by reference numeral 126). The eccentric coupling mechanism 58 may comprise a driveshaft 60 that is configured to be driven for rotation about an axis 62. At a front end of the driveshaft 60 facing the blade set 22 an eccentric portion 66 may be provided. The eccentric portion 66 may comprise a cylindrical portion which is offset from the (central) axis 62. Upon rotation of the driveshaft 60, the eccentric portion 66 may revolve around the axis 62. The eccentric portion 66 is arranged to engage a transmitting member 70 which may be attached to the movable blade 24.

Figure 3:
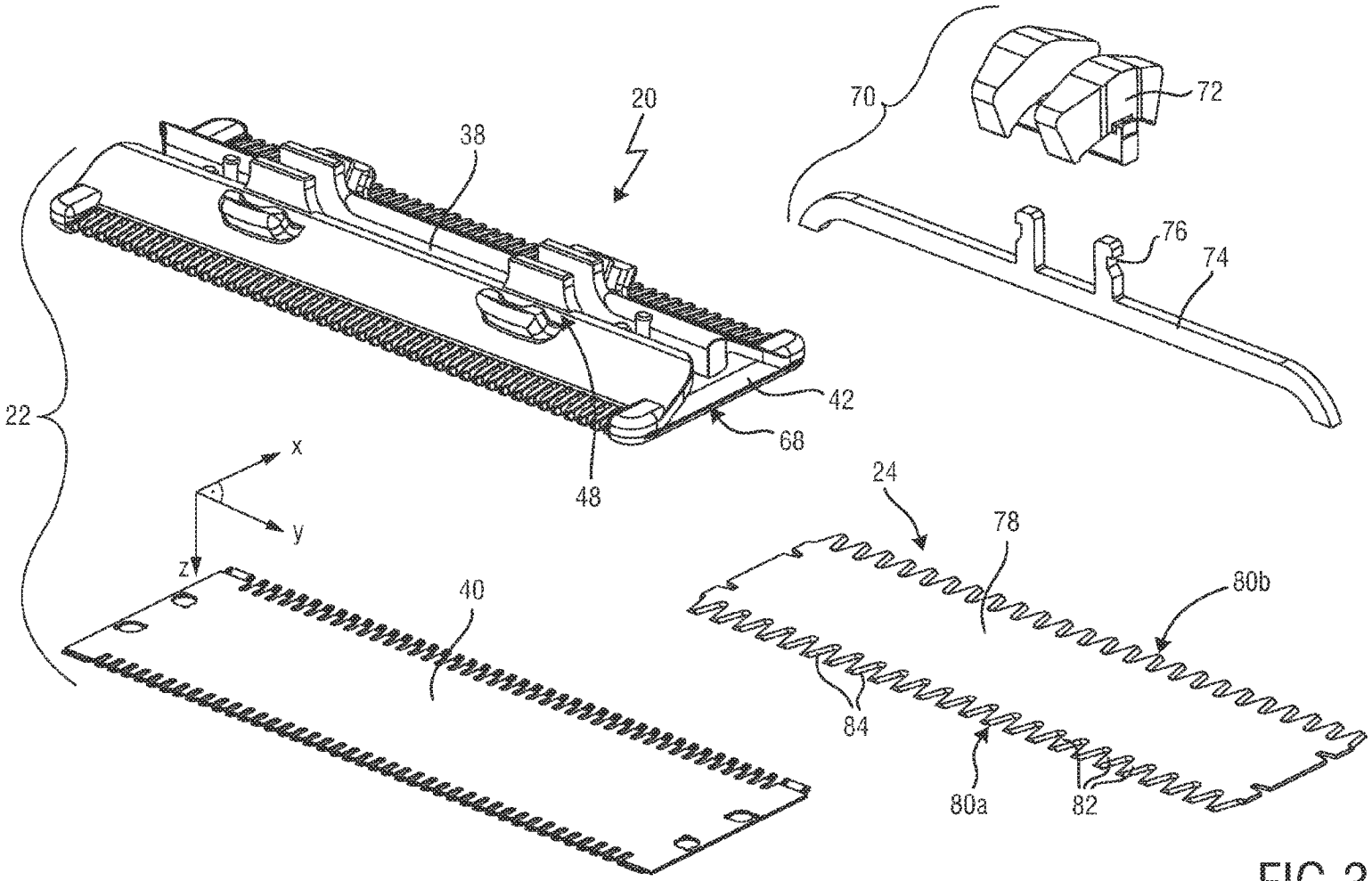
FIG. 3 is an exploded perspective bottom view of the blade set shown in FIG. 2.

With further reference to the exploded view shown in FIG. 3, the transmitting member 70 will be further detailed and described. The transmitting member 70 may comprise a reciprocating element 72 which may be configured to be engaged by the eccentric portion 66 of the driveshaft 60, refer also to FIG. 2. Consequently, the reciprocating element 72 may be reciprocatingly driven by the driveshaft 60. The transmitting member 70 may further comprise a connector bridge 74 which may be configured to contact the movable blade 24, particularly a main portion 78 thereof. By way of example, the connector bridge 74 may be bonded to the movable cutter blade 24. Bonding may involve soldering, welding and similar processes. However, at least in some embodiments, the connector bridge 74 or a similar connecting element of the transmitting member 70 may be rather attached to the movable cutter blade 24. As used herein, attaching may involve plugging in, pushing in, pressing in or similar mounting operations. The transmitting member 70 may further comprise a mounting element 76 which may be arranged at the connector bridge 74. At the mounting element 76, the reciprocating element 72 may be attached to the connector bridge 74. By way of example, the connector bridge 74 and the mounting element 76 may be arranged as a metal part. By way of example, the reciprocating element 72 may be arranged as a plastic part. For instance, the mounting element 76 may involve snap-on elements for fixing the reciprocating element 72 at the connector bridge 74. However, in the alternative, the mounting element 76 may be regarded as an anchoring element for the reciprocating element 72 when the latter one is firmly bonded to the connector bridge 74.

It is worth mentioning in this regard that the transmitting member 70 may be primarily arranged to transmit a lateral reciprocating driving motion to the movable cutter blade 24. However, the transmitting member 70 may be further arranged to serve as a loss prevention device for the movable cutter blade 24 at the blade set 20.

FIG. 3 further illustrates the plastic component 38 and the metal component 40 of the stationary blade 22 in an exploded state. It is worth mentioning in this connection that, since it is preferred that the stationary blade 22 is integrally formed, the plastic component 38 thereof typically does not exist as such in an isolated unique state. Rather, at least in some embodiments, forming the plastic component 38 may necessarily involve firmly bonding the plastic component 38 to the metal component 40.

The stationary blade 22 may comprise at least one lateral opening 68 through which the movable cutter blade 24 may be inserted. Consequently, the movable cutter blade may be inserted in the lateral direction Y. However, at least in some embodiments, the transmitting member 70 may be moved to the movable cutter blade 24 basically along the vertical direction Z. Mating the movable cutter blade 24 and the transmitting member 70 may therefore involve firstly inserting the movable cutter blade 24 through the lateral opening 68 of the stationary blade 22 and secondly, when the movable cutter blade 24 is arranged in the stationary blade 22, feeding or moving the transmitting member along the vertical direction Z to the stationary blade 22 so as to be connected to the movable cutter blade 24.

Generally, the movable cutter blade 24 may comprise at least one toothed leading edge 80 adjacent to the main portion 78. Particularly, the movable cutter blade 24 may comprise a first leading edge 80*a* and a second leading edge 80*b* that is longitudinally offset from the first leading edge 80*a*. At the at least one leading edge 80, a plurality of teeth 82 may be formed that are alternating with respective tooth slots. Each of the teeth 82 may be provided with respective cutting edges 84, particularly at their lateral flanks. The at least one toothed leading edge 80 of the movable cutter blade 24 may be arranged to cooperate with a respective toothed leading edge 30 of the stationary blade 22 when relative motion of the movable cutter blade 24 and the stationary blade 22 is induced. Consequently, the teeth 36 of the stationary blade 22 and the teeth 82 of the movable cutter blade 24 may cooperate to cut hair.

Figure 4:
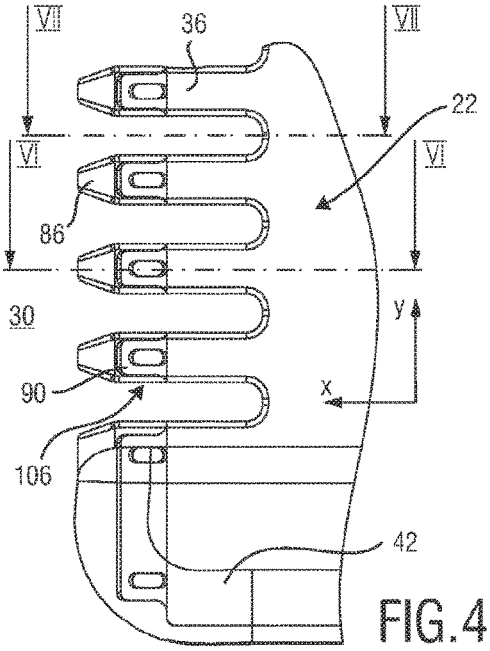
FIG. 4 is a partial top view of a stationary blade of the blade set shown in FIG. 2, wherein hidden edges of the stationary blade are shown for illustrated purposes.

With particular reference to FIGS. 4 to 9, the structure and configuration of an exemplary embodiment of the stationary blade 22 will be further detailed and illustrated. FIG. 4 is a partial top view of the stationary blade 22, wherein hidden portions of the metal component 40 (refer also to FIG. 5) are shown for illustrative purposes. At the teeth 36 of the stationary blade 22 tips 86 may be formed. The tips 86 may be primarily formed by the plastic component 38. However, substantial portions of the teeth 36 may be formed by the metal component 40. As can be best seen from FIG. 5, the metal component 40 may comprise so-called tooth stem portions 88 that may form a substantial portion of the teeth 36. The tooth stem portions 88 may be provided with respective cutting edges 94 that are configured to cooperate with cutting edges 84 of the teeth 82 of the movable cutter blade 24. At longitudinal ends of the tooth stem portions 88, anchoring elements 90 may be arranged. The anchoring elements 90 may be regarded as positive fit contact elements which may further strengthen the connection of the metal component 40 and the plastic component 38.

Figure 5:
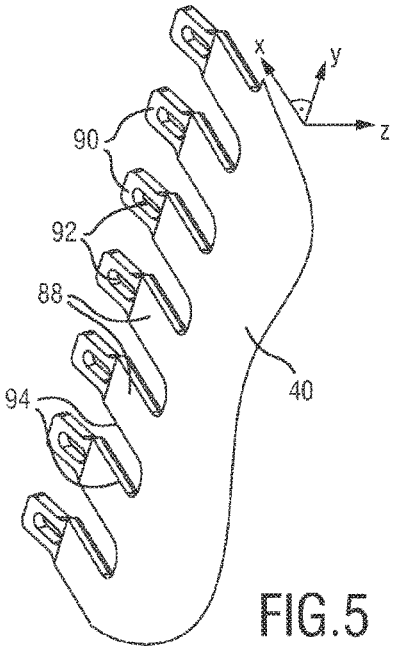
FIG. 5 is a partial perspective bottom view of a metal component of the stationary blade shown in FIG. 3.

By way of example, the anchoring elements 90 may be provided with undercuts or recess portions. Consequently, the anchoring elements 90 may be arranged as barbed anchoring elements. Preferably, a respective portion of the plastic component 38 that contacts the anchoring elements 90 may not be detached or released from the metal component 40 without being damaged or even destroyed. In other words, the plastic component 38 may be inextricably linked with the metal component 40. As shown in FIG. 5, the anchoring elements 90 may be provided with recesses or holes 92. The holes 92 may be arranged as slot holes, for instance. When molding the plastic component 38, plastic material may enter the holes 92. As can be best seen from FIGS. 6 and 8, the plastic material may fill the recesses or holes 92 of the anchoring elements 90 from both (vertical) sides, i.e. from the top side and the bottom side. Consequently, the anchoring elements 90 may be entirely covered by the plastic component 38. Adjacent to the anchoring elements 90, the tips 86 may be formed. Forming the tips 86 from the plastic component 38 may further have the advantage that the frontal end of the leading edge 30 is formed from a relatively soft material which may be further rounded or chamfered so as to soften edges. Consequently, contacting the user's skin with the frontal ends of the leading edge 30 is typically not experienced as causing skin irritation or similar adverse effects. Also high-temperature spots may be prevented at the tips 36 since the plastic component 38 is typically provided with a relatively low thermal conductivity coefficient, compared with the metal component 40.

Figure 8:
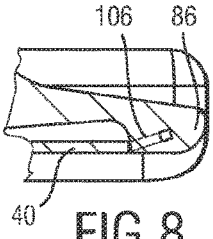
FIG. 8 is an enlarged detailed view of the stationary blade shown in FIG. 6 at a leading edge portion thereof.
Figure 6:
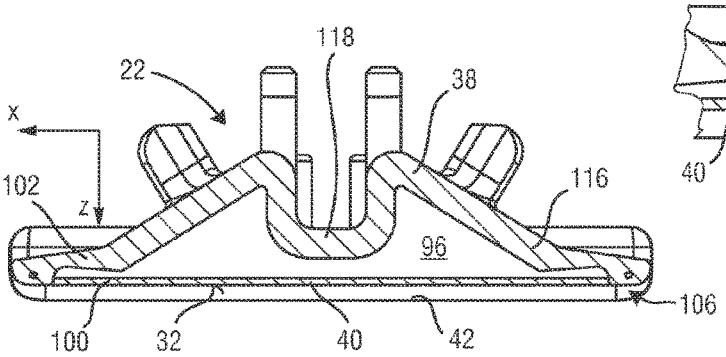
FIG. 6 is a cross-sectional view of the stationary blade shown in FIG. 4 taken along the line VI-VI in FIG. 4.
Figure 7:
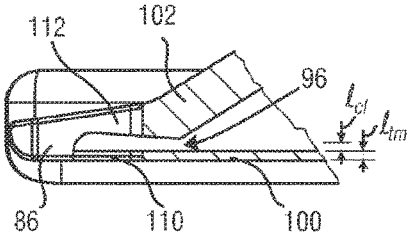
FIG. 7 is a partial cross-sectional side view of the stationary blade shown in FIG. 4 taken along the line VII-VII in FIG. 4.
Figure 9:
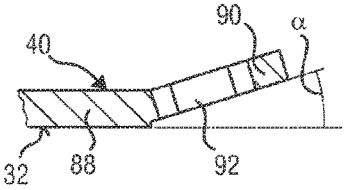
FIG. 9 is an enlarged detailed view of the metal component of the stationary blade basically corresponding to the view of FIG. 8.

As can be best seen from the cross-sectional views of FIGS. 6, 7 and 8, the edges of the tips 86 of the teeth 36 at the frontal ends of the leading edges 30 may be significantly rounded. As can be further seen, the transition between the metal component 40 and the plastic component 38 at the top surface 32 in the region of the teeth 36 may be substantially seamless or step-less. Further reference in this regard is made to FIG. 9. It may be advantageous to shape the anchoring elements 90 such that their top side (skin-facing side) is offset from the top surface 32. Consequently, also the skin-facing side of the anchoring elements 90 may be covered by the plastic component, refer also to FIG. 8. In one embodiment, the anchoring elements 90 may be inclined with respect to the top surface 32. The anchoring elements 90 may be arranged at an angle $\alpha$ (alpha) with respect to the tooth stem portions 88. It may be further preferred that the anchoring elements 90 are rearwardly bended with respect to the top surface 32. At least in some embodiments, the anchoring elements 90 may be thinner than the tooth stem portions 88. This may further enlarge the space which may be filled by the plastic component 38 when molding.

With further reference to FIG. 6, the stationary blade 22 will be further detailed and described. The stationary blade 22 may define and encompass a guide slot 96 for the movable cutter blade 24. To this end, the stationary blade 22 may comprise a first wall portion 100 and a second wall portion 102. For the purpose of this disclosure, the first wall portion 100 may be regarded as a skin-facing wall portion. This applies in particular when the blade set 20 is used for shaving. Consequently, the second wall portion 102 may be regarded as the wall portion facing away from the skin. In other words, the first wall portion 100 may be also referred to as top wall portion. The second wall portion 102 may also be referred to as bottom wall portion.

The first wall portion 100 and the second wall portion 102 may jointly define the teeth 36 of the stationary blade. The teeth 36 may comprise a slot or gap for the movable cutter blade 24, particularly for the teeth 82 thereof arranged at the at least one toothed leading edge 80. As indicated above, at least a substantial portion of the first wall portion 100 may be formed by the metal component 40. At least a substantial portion of the second wall portion 102 may be formed by the plastic component 38. At the exemplary embodiment illustrated in FIG. 6, the second wall portion 102 is entirely formed by the plastic component 38. Rather, the first wall portion 100 is jointly formed by the plastic component 38 and the metal component 40. This applies in particular at the leading edge 30. The first wall portion 100 may comprise, at the respective tooth portions thereof, bonding portions 106, where the plastic component 38 is bonded to the metal component 40. The bonding portions 106 may involve the anchoring elements 90 of the metal component 40 and the plastic material of the plastic component 38 covering the anchoring elements 90.

FIG. 6 and FIG. 8 illustrate a cross-section through a tooth 36, refer also to the line VIII-VIII in FIG. 4. By contrast, FIG. 7 illustrates a cross-section through a tooth slot, refer to line VII-VII in FIG. 4. As can be seen from FIG. 6 and FIG. 7, the first wall portion 100 and the second wall portion 102 may jointly form the leading edge 30 including the teeth 36. The first wall portion 100 and the second wall portion 102 may jointly define a basically U-shaped lateral cross-section of the respective teeth 36. The first wall portion 100 may define a first leg 110 of the U-shaped form. The second wall portion 102 may define a second leg of the U-shaped form. The first leg 110 and the second leg 112 may be connected at the tips 86 of the teeth 36. Between the first leg 110 and the second leg 112 a slot or gap for the movable cutter blade 24 may be provided.

As can be further seen from FIG. 6, the first wall portion 100 may be significantly thinner than the second wall portion 102 of the stationary blade 22. Consequently, at the skin-facing first wall portion 100, hair can be cut very close to the skin. It is therefore desirable to reduce the thickness of the first wall portion 100, particularly of the metal component 40. By way of example, the thickness $l_{tm}$ (refer to FIG. 7) of the metal component 40, particularly at the tooth stem portions 88, may be in the range of about 0.08 mm to 0.15 mm. Consequently, the first wall portion 100 as such may exhibit a considerably small strength and rigidity. It is therefore beneficial to back up or strengthen the first wall portion 100 by adding the second wall portion 102. Since the thickness of the second wall portion 102 basically does not influence the smallest achievable cutting length (e.g. the length of remaining hairs at the skin), the thickness of the second wall portion 102, particularly at the respective leading edges 30, may be significantly greater than the thickness $l_{tm}$ of the first wall portion 100, particularly of the metal component 40. This may provide the stationary blade 22 with sufficient strength and stability. As can be further seen from FIG. 6, the first wall portion 100 and the second wall portion 102 may basically form a closed profile, at least sectionally along their lateral extension, refer also to FIG. 10 and FIG. 11 in this connection. This may particularly apply when the stationary blade 22 is provided with a first and a second leading edge 30*a*, 30*b*. Consequently, the stiffness of the stationary blade 22, particularly the stiffness against bending stress or torsional stress may be further increased.

In one embodiment, the second wall portion 102 may comprise, adjacent to the second leg 112 at the respective leading edge 30, an inclined portion 116. Assuming that the stationary blade 22 is basically symmetrically shaped with respect to a central plane defined by the vertical direction Z and the lateral direction Y, the second wall portion 102 may further comprise a central portion 118 adjacent to the inclined portion 116. Consequently, the central portion 118 may be interposed between a first inclined portion 116 and a second inclined portion 116. The first inclined portion 116 may be positioned adjacent to a respective second leg 112 at a first leading edge 30*a*. The second inclined portion 116 may be positioned adjacent to a respective second leg at the second leading edge 30*b*. As can be best seen in FIG. 6, the second wall portion 102 may therefore comprise a basically M-shaped cross-section primarily defined by the inclined portions 116 and the central portion 118.

Figure 10:
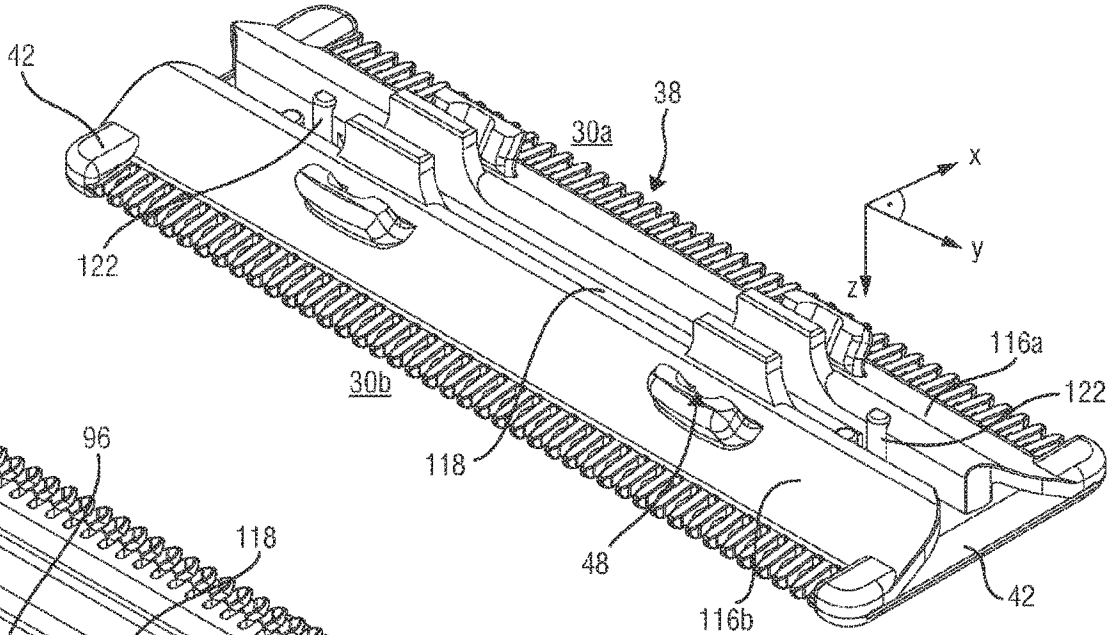
FIG. 10 is a perspective bottom view of a plastic component of the stationary blade shown in FIG. 2 and FIG. 3.
Figure 11:
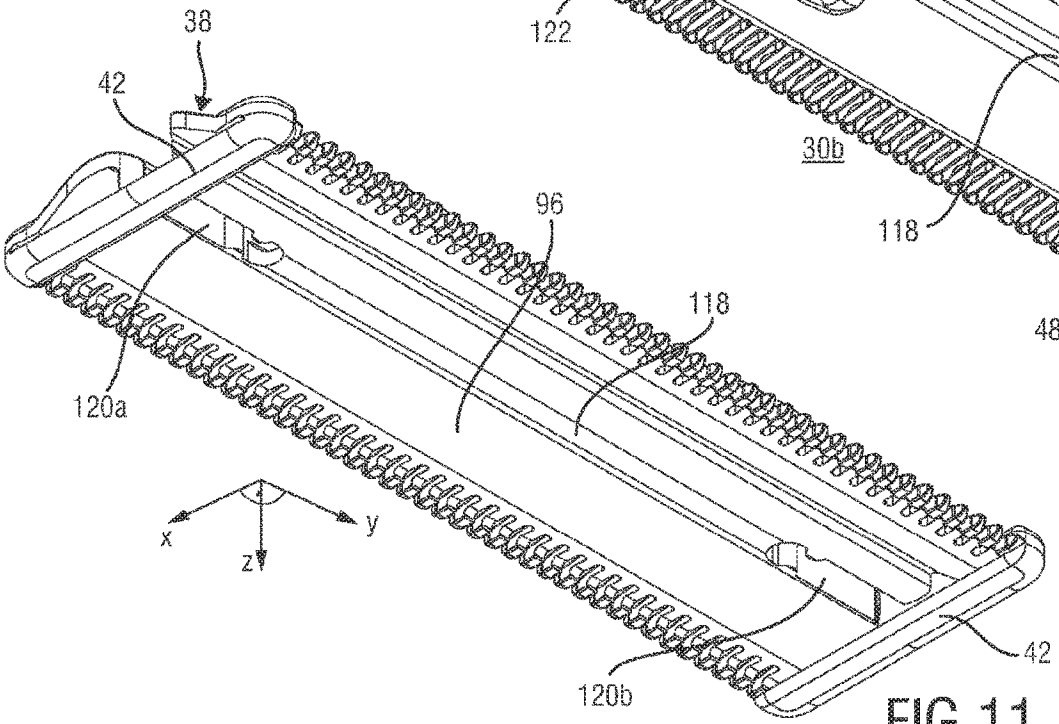
FIG. 11 is a perspective top view of the plastic component shown in FIG. 10.

With further reference to FIG. 10 and FIG. 11, the shape and configuration of an exemplary embodiment of the plastic component 38 of the stationary blade 22 is further detailed and described. As can be best seen in FIG. 10, the inclined portions 116*a*, 116*b* may basically extend for the whole (lateral) length of the plastic component 38. The leading edges 30*a*, 30*b* may generally extend between a first lateral protection element 42 and a second lateral protection element 42 that are arranged at opposite (lateral) ends of the plastic component 38. A recessed portion of the plastic component shown in FIG. 8 which basically defines a bottom side of the guide slot 96 is generally covered by the metal component 40, refer to FIG. 2.

As can be best seen from FIG. 11, the central portion 118 between the inclined portions 116*a*, 116*b* may generally extend for a substantial portion of the entire (lateral) length of the plastic component 38. However, alongside the central portion 118, at least one opening slot 120 may be provided. According to the exemplary embodiment shown in FIG. 10 and FIG. 11, the central portion 118 may be arranged between a first opening slot 120*a* and a second opening slot 120*b*. The opening slots 120*a*, 120*b* may define at least one opening through which, in the assembled state, the movable cutter blade 24 may be contacted by the transmitting member 70. As can be best seen in FIG. 10, the plastic component 38 may further comprise at least one guide element 122, particularly a plurality of guide elements 122 that may be configured to guide the connector bridge 74 and, consequently, the movable cutter blade 24 connected thereto. In one embodiment, the plurality of guide elements 122 may be arranged in pairs, wherein respective pairs are arranged at laterally offset ends of the central portion 118. The guide elements 122 may be arranged as basically vertically extending convexly shaped profiles. The guide elements 122 may define a longitudinal position of the transmitting member 70 and the movable cutter blade 24.

It is further worth mentioning in this regard that the central portion 118 and particularly the at least one opening slot 120 for the transmitting member 70 may be differently configured in alternative embodiments. By way of example, in one embodiment, the central portion 118 is interrupted by a single opening slot 120 through which the connector bridge 74 may contact the movable cutter blade 24. It is therefore emphasized that the connector bridge 74 of the transmitting member 70 does not necessarily have to comprise two contact spots for the movable cutter blade 24 that are considerably spaced from each other in the lateral direction Y, as can be seen in FIG. 3. Rather, the connector bridge 74 may also contact the movable cutter blade 24 at a (lateral) central portion.

Figure 12:
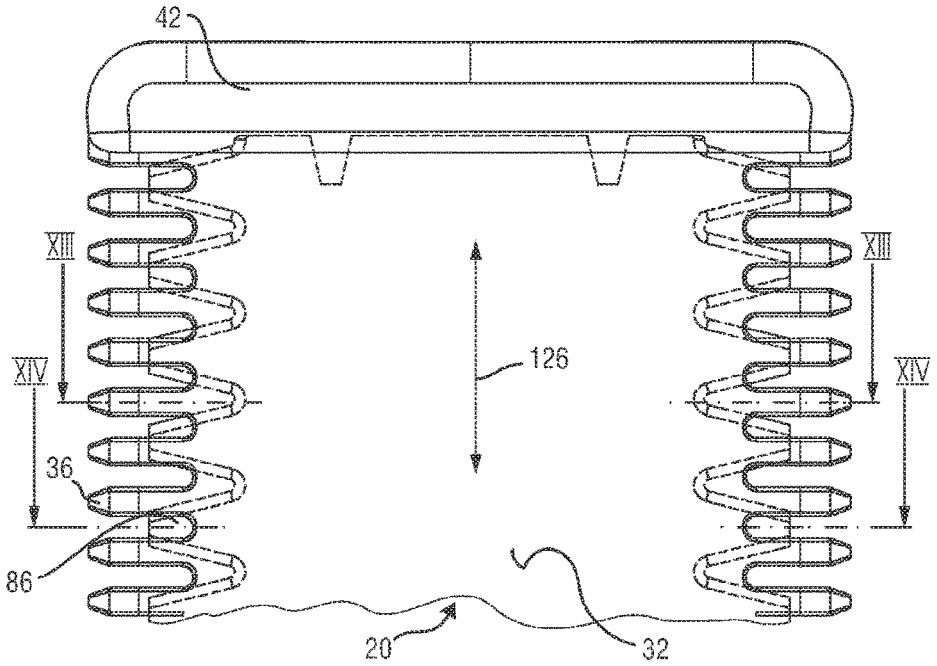
FIG. 12 is a partial top view of the blade set shown in FIG. 2 and FIG. 3, wherein hidden contours of a movable cutter blade thereof are indicated by dashed lines primarily for illustrative purposes.
Figure 13:
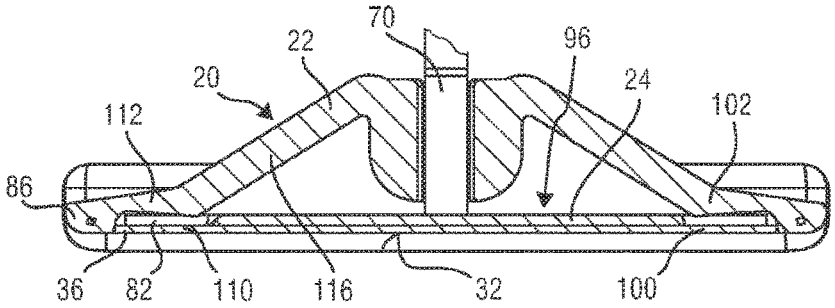
FIG. 13 is a cross-sectional side view of the blade set shown in FIG. 12 taken along the line XIII-XIII in FIG. 12.
Figure 14:
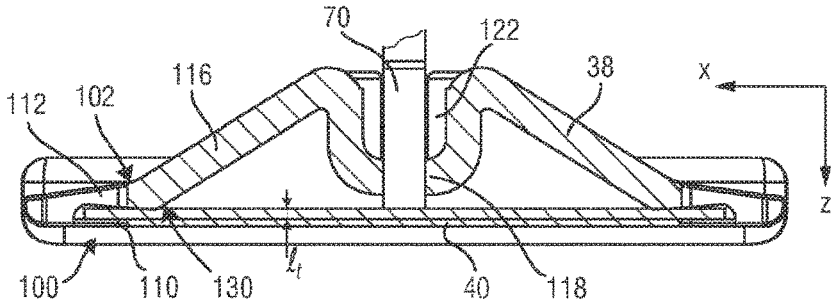
FIG. 14 is a further cross-sectional side view of the blade set shown in FIG. 12 taken along the line XIV-XIV in FIG. 12.

With particular reference to FIGS. 12, 13 and 14, the blade set 20 including the stationary blade 22 being fitted with the movable blade 24 is further detailed and described. FIG. 12 is a partial top view of the blade set 20, wherein hidden contours of the movable cutter blade 24 are indicated by dashed lines. FIG. 13 is a cross-sectional view of the arrangement shown in FIG. 12, wherein the section involves a tooth 36 at the stationary blade 22 and a tooth slot at the movable cutter blade 24, refer to the line XIII-XIII in FIG. 12. By contrast, the cross-sectional view shown in FIG. 14 includes a section through a tooth slot at the stationary blade 22 and a tooth 82 at the movable cutter blade 24, refer to line XIV-XIV in FIG. 12. The movable cutter blade 24 can be driven with respect to the stationary blade 22 in a reciprocating manner, refer to a double-arrow indicated by 126 in FIG. 12. Upon relative motion of the stationary blade 22 and the movable cutter blade 24, the respective teeth 36 and 82 may cooperate to cut hairs that enter the respective tooth slots.

The transmitting member 70 which is basically configured to transmit the driving motion to the movable cutter blade 24 may extend through the stationary blade 22, particularly through the at least one opening slot 120 associated with the central portion 118 of the stationary blade 22, refer to FIG. 11. FIG. 14 further shows a pair of guide elements 122 that may guide the transmitting member 70 and, consequently, the movable cutter blade 24. The guide elements 122 may define the longitudinal position of the transmitting member 70 and the movable cutter blade 24 at the stationary blade 22.

It is particularly preferred that, at least in some embodiments, the movable cutter blade 24 is arranged in the guide slot 96 in a defined manner. It may be further preferred that no further mounting member, particularly no biasing member is required for keeping the movable cutter blade 24 in its desired position and in close contact with the first wall portion 100. This may be achieved since the stationary blade 22 is provided with the first wall portion 100 and the second wall portion 102 opposite to the first wall portion 100. Both wall portions 100, 102 may define a precise mating slot for the movable cutter blade 24, particularly for the teeth 82 thereof, such that the vertical position (Z-position) of the movable cutter blade 24 may be defined at close tolerances. This may significantly reduce manufacturing and assembly costs of the blade set 20.

By way of example, the stationary blade 22 and the movable cutter blade 24 may be configured such that the movable cutter blade 24 at least sectionally contacts the first wall portion 100 in a substantially planar fashion. This may particularly apply to respective tooth portions. It is worth mentioning in this connection that such a configuration does not require perfect surface contact in practice when the blade set 20 is operated. By contrast, it may be assumed that the stationary blade 22 and/or the movable cutter blade 24 may be flexed or preloaded, at least when in operation, such that only small contact areas remain. However, the first wall portion 100 may serve at least as a defined limit stop for the movable cutter blade 24 in the (vertical) direction Z. The second wall portion 102 may comprise a protruding contact surface 130 which is associated with a respective toothed leading edge 30. The protruding contact surface 130 may be arranged at a transition between the second leg 112 and the inclined portion 116 of the second wall portion 102, refer to FIG. 14. The protruding contact surface 130 may define a resulting gap or height dimension at the guide slot 96 for the movable cutter blade 24. The resulting gap $l_{cl}$ (refer to FIG. 7) may be defined such that a defined clearance for the to-be-mounted movable cutter blade 24 is provided. Consequently, the movable cutter blade 24 may be arranged at the stationary blade 22 without significant preload, at least in an inactive state. However, in yet another embodiment, the gap or height dimension for the to-be-mounted cutter blade 24 in the slot 96 may be defined such that basically an interference fit is provided. Consequently, the movable cutter blade 24 may be at least slightly preloaded by the stationary blade 22. The height dimension or thickness dimension $l_t$ (refer to FIG. 14) of the movable cutter blade 24, at least at the at least one toothed leading edge 80 thereof, may be in the range of 0.1 mm to 0.18 mm.

Figure 15:
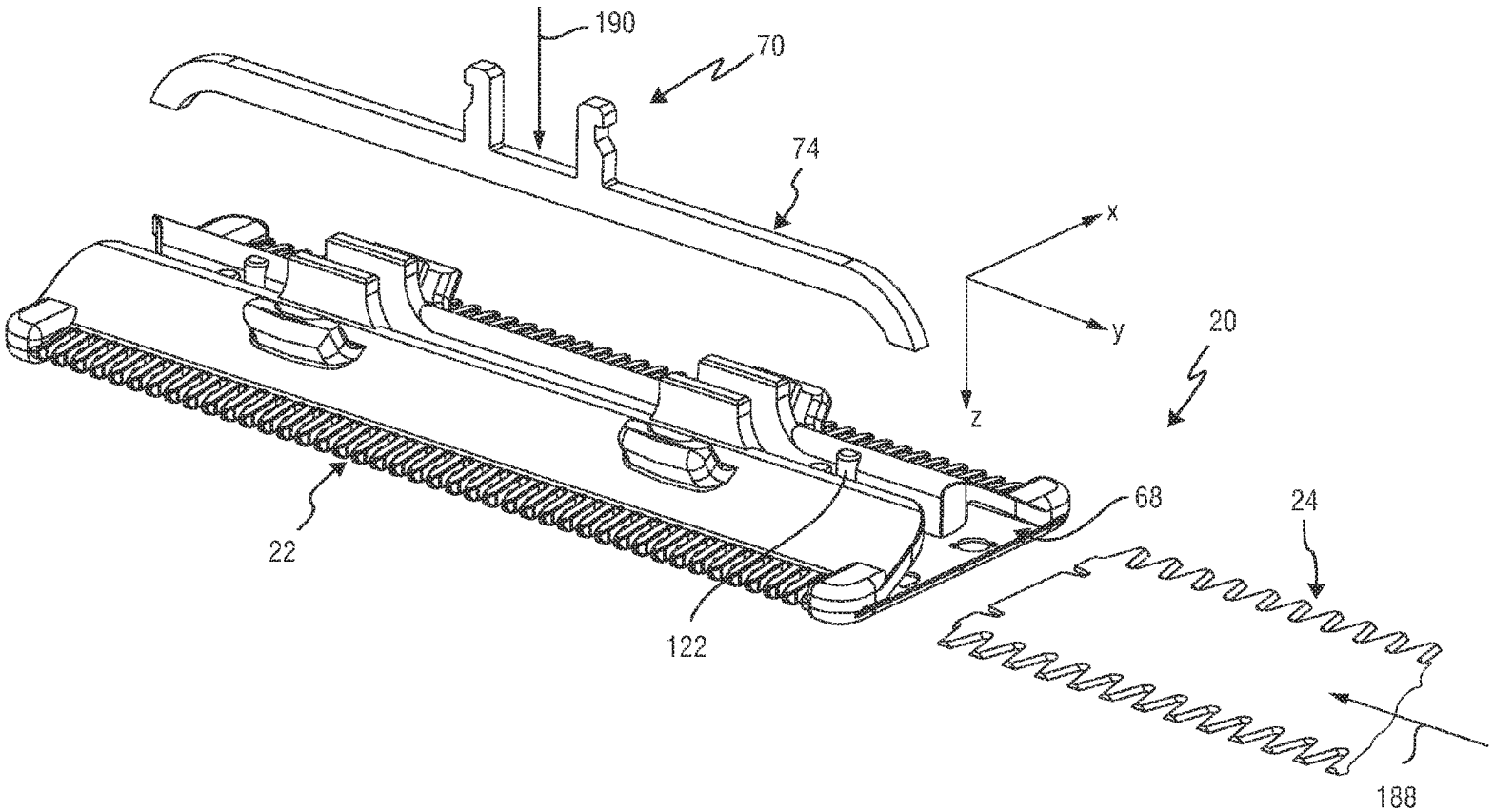
FIG. 15 shows a perspective bottom view of a blade set in accordance with the present disclosure, the blade set being shown in an exploded state.
Figure 16:
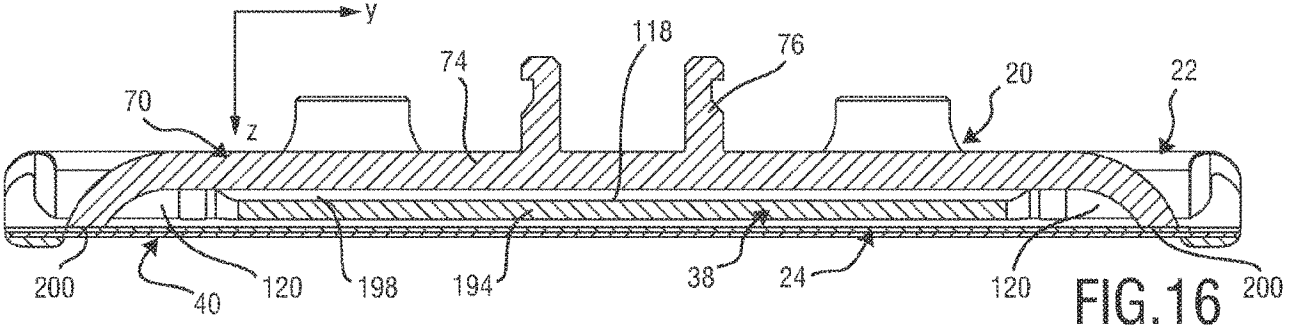
FIG. 16 illustrates a lateral cross-sectional view, taken along the line XVI-XVI in FIG. 17, of the blade set shown in FIG. 15, the blade set being shown in a mounted state.
Figure 17:
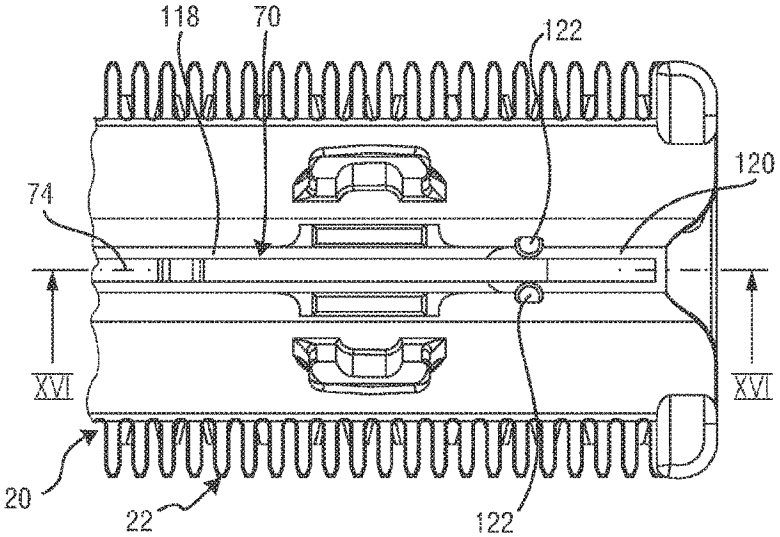
FIG. 17 shows a partial bottom view of the blade set shown in FIG. 16.

With particular reference to FIGS. 15, 16 and 17, an exemplary mounting process for mounting a movable blade 24 in accordance with several aspects of this disclosure to a stationary blade in accordance with several aspects of the disclosure is further described and detailed hereinafter. As can be best seen in FIG. 15, the stationary blade 22 may comprise at least one lateral opening 68 through which the guide slot 96 is accessible, refer also to FIG. 5. Consequently, the movable blade 24 can be moved to the guide slot 96 along an insertion direction 188 which may be basically parallel to the lateral direction Y. Since the guide slot 96 may be accessible through the lateral opening 68, the movable blade 24 basically needs to be secured against undesired displacement in the lateral direction Y.

To this end, a transmitting member 70 in accordance with at least some aspects disclosed herein may be attached to the movable blade 24. The transmitting member 70 primarily may be regarded as a force transmitting member 70 for driving the movable cutter blade 24, particularly for reciprocatingly driving the movable cutter blade 24. However, the application range of the transmitting member 70 may be enhanced. The transmitting member 70 may further serve as a locking element for the movable cutter blade 24 in its mounted state at the stationary blade 22 of the blade set 20. Further reference in this regard is made to FIGS. 16 and 17 illustrating the blade set 20 in a mounted state. The stationary blade 22, particularly the plastic component 38 thereof, may comprise a central portion 118 as already described in connection with FIGS. 6, 10 and 11. The central portion 118 may connect respective sides of the second wall portion 102 formed by the plastic component 38, each of which may comprise an inclined portion 116 and second legs 112 at the toothed cutting edge 30. The central portion 118 may also comprise a retaining tab 194 for the movable cutter blade 24.

As particularly shown in FIG. 16, the transmitting member 70, particularly the connector bridge 74 thereof may be attached to the movable cutter blade 24 in such a way that the movable cutter blade 24 is arranged at the stationary blade 22 in a basically secured manner. More particularly, the movable cutter blade 24 may be undetachably retained at the stationary blade 22. To this end, the transmitting member 70 and the movable blade 24, particularly the (central) main portion 78 thereof may cooperate so as to define the position of the movable cutter blade 24 in a form-fit manner. By way of example, the transmitting member 70 may comprise a basically arc-shaped connector bridge 74 which may be coupled to the movable cutter blade 24 such that a securing opening 198 is defined therebetween. At the central portion 118 of the stationary blade 22, the retaining tab 194 may basically extend through the securing opening 198 in the longitudinal direction (X-direction). Consequently, the movable blade 24 cannot be removed from the stationary blade 22 through the lateral opening 68.

In other words, the stationary blade 22, on the one hand side, may define a first loop, particularly a first loop extending in a plane defined by the longitudinal axis X and the vertical axis Z. The first loop may be jointly defined by the first wall portion 100 and the second wall portion 102. On the other hand, the movable cutter blade 24 and the transmitting member 70 may jointly define a second loop basically extending in a plane defined by the lateral direction Y and the vertical direction Z. The first loop and the second loop may be engaged such that they simply cannot be released from each other without damaging or even destroying components thereof. Consequently, the movable cutter blade 24 may be received at the stationary blade 22 in a locked or secured manner without the need of further locking components.

As can be best seen in FIG. 16, the connector bridge 74 may basically extend from a first lateral end of the movable cutter blade 24 to a second lateral end thereof. The connector bridge 74 may further extend, starting from the guide slot 96, through respective opening slots 120 adjacent the central portion 118. At a rear side or bottom side of the second wall portion 102, the connector bridge 74 may basically extend in the lateral direction Y and thereby connecting the respective lateral ends of the movable cutter blade 24. The transmitting member 70 and the second wall portion 102, particularly the central portion 118 thereof, may further cooperate to define an allowed lateral motion range for the movable cutter blade 24. As can be best seen in FIG. 16, the securing opening 198 defined by the transmitting member 70 and the movable cutter blade 24 may comprise a lateral extension that is larger than the lateral extension of the retaining tab 194. Consequently, the movable cutter blade 24 may be reciprocatingly moved in the lateral direction Y, whereas any contact (lateral contact) between the connector bridge 74 and the retaining tab 194 may limit the motion of the movable cutter blade 24. It should be further mentioned that generally a reciprocating stroke defined by the eccentric portion 66 of the driveshaft 60 (refer also to FIG. 2) may be selected to be smaller than a potential range of the reciprocating motion allowed by the cooperation of the connector bridge 74 and the retaining tab 194.

Figure 18:
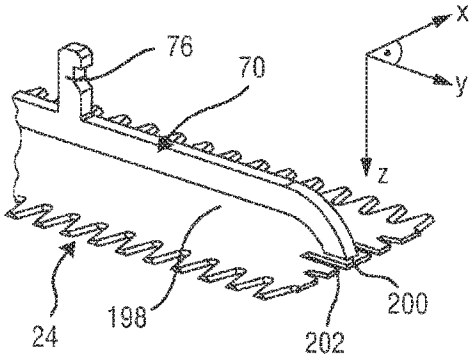
FIG. 18 shows a partial perspective bottom view of an alternative embodiment of a movable cutter blade to which a transmitting member is attached.

At least in some embodiments, the transmitting member 70 may be bonded to the movable cutter blade 24 at respective bonding spots 200. The bonding spots 200 are typically arranged at lateral ends of the main portion 78 of the movable cutter blade 24. Bonding the transmitting member 70 to the movable cutter blade 24 may particularly involve laser bonding. Also soldering or similar bonding processes may be envisaged in this regard. Bonding typically requires heat input at the to-be-bonded components. Given that the movable cutter blade 24 may be a particularly thin metal component, particularly a sheet metal component, it may not be unlikely that a considerable heat input may distort the shape of the movable cutter blade 24. This might adversely affect a smooth running of the movable cutter blade 24 in the guide slot 96. It might be therefore beneficial, at least in some embodiments, to provide the movable cutter blade 24, particularly the lateral ends thereof with relief slots 202, particularly with laterally extending relief slots 202. As can be best seen in FIG. 18, two respective longitudinally spaced relief slots 202 may be arranged adjacent to the bonding spot 200.

With respect to the process of bonding the transmitting member 70 to the movable cutter blade 24, it might be particularly beneficial when the movable cutter blade 24 and the transmitting member 70 may be laterally shifted with respect to the stationary blade 22 such that the bonding spot 200 laterally projects from the lateral opening 68. Consequently, the bonding spot 200 may be accessible for bonding the components in the vertical or height direction (Z-direction).

Figure 20:
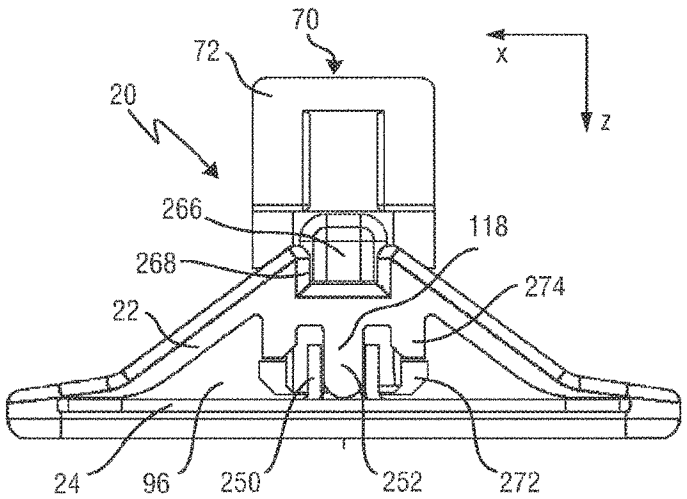
FIG. 20 is a side view of a blade set including a stationary blade and a movable blade in accordance with the embodiment shown in FIG. 19.
Figure 19:
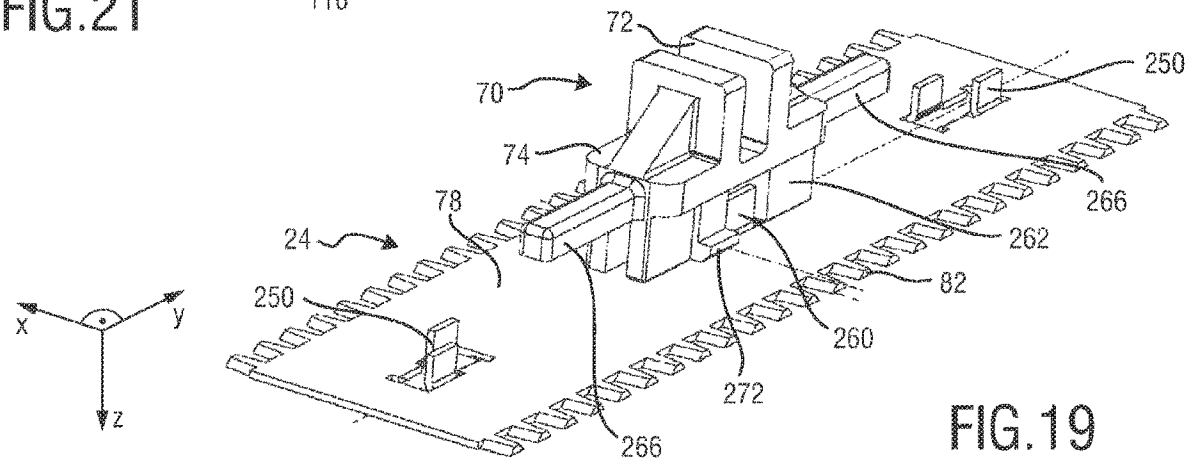
FIG. 19 is a perspective bottom view of yet another embodiment of a movable blade to which a transmitting member is attached.
Figure 21:
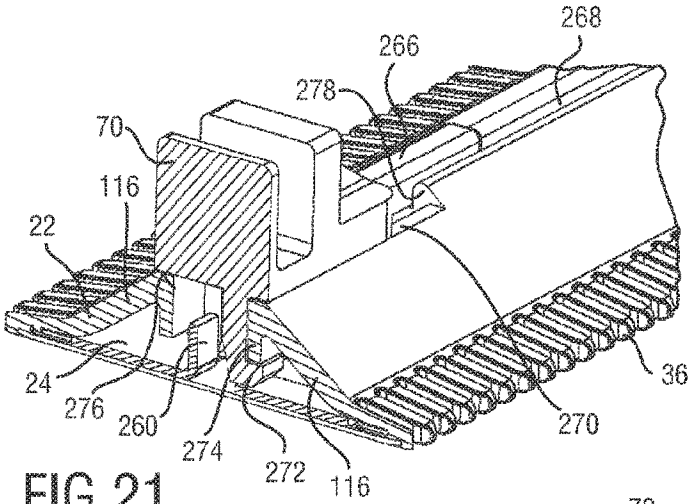
FIG. 21 is a perspective cross-sectional top view illustrating a longitudinally extending cross-section of the blade set shown in FIG. 20.

With particular reference to FIGS. 19, 20 and 21, an alternative embodiment of a blade set 20 is illustrated and further described. With respect to the general layout and the toothed leading edges, the stationary blade 22 and the movable blade 24 shown in FIGS. 19, 20 and 21 may basically correspond to the embodiment shown in FIG. 3, for instance. As already described above, the stationary blade 22 may be arranged as a metal-plastic composite stationary blade 22 comprising a first wall portion 100 substantially defined by a metal component 40, and a second wall portion 102 substantially defined by a plastic component 38. However, particularly the attachment of the transmitting members 70 to the movable cutter blade 74 is modified in FIGS. 19 to 21. The embodiments illustrated in FIGS. 15 to 21 elucidate several aspects of blade sets 20 in accordance with the present disclosure. It goes without saying that at least some aspects disclosed in a distinct embodiment are interchangeable. Consequently, at least some aspects of a particular embodiment may be implemented in further distinct embodiments without the need to implement each and any aspect of that particular embodiment.

As can be best seen in FIG. 19, the movable cutter blade 24 may comprise an arrangement of guiding tabs 250. The guiding tabs 250 may be integrally formed with the movable cutter blade 24. Particularly, assuming that the movable cutter blade 24 is basically a sheet metal component, the guiding tabs 250 may be obtained by cutting and bending respective portions of the main portion 78 of the movable cutter blade 24. As shown in FIG. 19, the movable cutter blade 24 may comprise a first arrangement of guiding tabs 250 and a second arrangement of guiding tabs 250 each of which is associated with a respective lateral end of the movable cutter blade 24. At the second wall portion 102 of the stationary blade 22, particularly at the central portion 118 thereof, at least one respective guiding protrusion 252 may be provided which may be configured to cooperate with the guiding tabs 250 for guiding the movable cutter blade 24 and for defining the longitudinal position of the movable cutter blade 24 with respect to the stationary blade 22. Consequently, an X-position of the movable cutter blade 24 may be defined by the stationary blade 22, particularly by the plastic component 38 thereof, refer also to FIG. 20. The longitudinal position of the movable cutter blade 24 shown in FIGS. 19 to 21 is directly defined by the stationary blade 22. By contrast, as with the embodiment illustrated in FIGS. 15, 16 and 17, the movable cutter blade 24 is in this respect indirectly guided since the longitudinal position (X-position) of the movable cutter blade 24 is defined by the transmitting member 70 particularly the connector bridge 74 thereof, which cooperates with respective guide elements 122 at the second wall portion 102, particularly adjacent the central portion 118 thereof, refer to FIG. 17.

The movable cutter blade 24 shown in FIG. 19 may further comprise an arrangement of engagement tabs 260 which may basically take a similar or even the same form as the guiding tabs 250. However, the guiding tabs 250 and the engagement tabs 260 do not necessarily have to be combined at an embodiment of the movable cutter blade 24. FIGS. 19, 20 and 21 further illustrate an exemplary embodiment of a transmitting member 70. The transmitting member 70 shown in FIG. 19 may be regarded as an attachable transmitting member 70, particularly a transmitting member 70 attachable in a snap-on manner. For instance, the transmitting member 70 may be plugged to the movable cutter blade 24 for laterally driving the movable cutter blade 24. It is particularly preferred that the transmitting member 70 can be detached from the movable cutter blade 24 without the need to damage or destroy any component. For engaging the movable cutter blade 24, the transmitting member 70 may comprise at least one engagement member 262 which may laterally contact the engagement tab 260. Even though the transmitting member 70 is not fixedly attached to the movable cutter blade 24, the movable cutter blade 24 may be secured at the stationary blade 22 via the transmitting member 70.

The transmitting member 70 may comprise a snap-on functionality with respect to the stationary blade 22. To this end, the transmitting member 70 may comprise at least one hook member 272, particularly at least one snap-on hook member 272. The at least one hook member 272 may be arranged to engage a retaining member 274 of the second wall portion 102 of the stationary blade 22, refer also to FIGS. 20 and 21. The movable cutter blade 24 may be laterally inserted into the guide slot 96. The transmitting member 70 may be vertically fed to the second wall portion 102 of the stationary blade 22. The transmitting member 70, particularly the at least one hook member 272 may be inserted in an insertion opening which may involve bending or flexing the at least one hook member 272. At a desired mounting position with respect to the vertical direction (Z-direction), the at least one hook member 272 may snap into place at the at least one retaining member 274 of the stationary blade 22. Consequently, the transmitting member 70 may be locked at the stationary blade. Consequently, also the movable cutter blade 24 may be secured and locked at the stationary blade as a result of the cooperation of the transmitting member 70 and the second wall portion 102 of the stationary blade 22. It is particularly preferred that the transmitting member 70 comprises a plurality of hook members 272 which may be oppositely arranged.

The transmitting member 70 may further comprise at least one laterally extending extension 266 which may also be referred to as lateral extension 266. Preferably, the transmitting member 70 comprises a first lateral extension 266 and a second lateral extension 266 opposite to the first lateral extension 266. The at least one lateral extension 266 may be configured to be received at a respective receiving slot or receiving portion 268 at the second wall portion 102 of the stationary blade 22. The lateral extension 266 and the receiving portion 268 may cooperate to define a longitudinal position of the transmitting member 70 with respect to the stationary blade 22. Consequently, the receiving portion 268 may be arranged as a recess at the second wall portion 102. The lateral extension 266 and the receiving portion 268 may comprise longitudinal contact surfaces basically extending in the lateral direction Y and the vertical direction Z.

The transmitting member 70 may further comprise at least one top contact surface 276 which is arranged to contact a seat portion 270 at the second wall portion 102 of the stationary blade 22. The top contact surface 276 and the seat portion 270 may basically comprise vertical contact surfaces substantially extending in the longitudinal direction X and the lateral direction Y. Consequently, the seat portion 270 and the top contact surface 276 may cooperate to define a vertical position of the transmitting member 70 with respect to the stationary blade 22. The stationary blade 22 may further comprise at least one limit stop 278 which may define a lateral movement range for the transmitting member 70 and, consequently, for the movable cutter blade 24. The limit stop 278 may be arranged adjacent to the seat portion 270. The seat portion 270 may be arranged as a recess in the second wall portion 102 comprising lateral end faces which may define the at least one limit stop 278.

The orientation and position of the transmitting member 70 with respect to the stationary blade 22 may be determined by a plurality of respective contact surfaces. The position and orientation of the movable cutter blade 24 with respect to the stationary blade 22 may be directly defined by the stationary blade 22 itself, for instance with respect to the longitudinal direction X and the vertical direction Z. The lateral position of the movable cutter blade 24 with respect to the stationary blade 24 may be defined by the transmitting member 70 which may engage the at least one arrangement of engagement tabs 260. The transmitting member 70 and, consequently, the movable cutter blade 24 may be locked and secured with respect to the stationary blade 22 in a form-fit or positive-fit manner.

Figure 22:
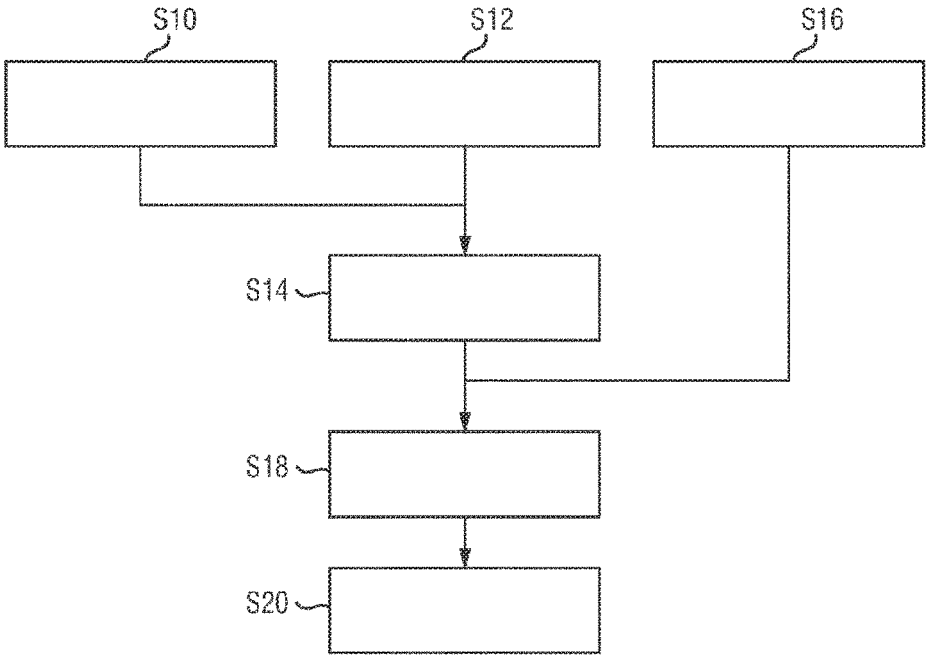
FIG. 22 shows an illustrative block diagram representing several steps of an embodiment of an exemplary method for manufacturing a blade set in accordance with several aspects of the present disclosure.

With further reference to FIG. 22, an exemplary manufacturing method for a blade set 20 is illustrated and further described. As can be seen from FIG. 22, the method may comprise a step S10 including providing a stationary blade which may also be referred to as stationary guard. It is preferred that the stationary blade is a metal-plastic composite stationary blade, particularly an integrally formed metal-plastic composite stationary blade. The stationary blade may comprise a guide slot for a movable cutter blade. At a further step S12, a respective movable cutter blade may be provided. A step S14 may follow which may include inserting the movable cutter blade into the guide slot of the stationary blade. The movable cutter blade may be slidably arranged in the guide slot.

At a further step S16, a transmitting member may be provided. The transmitting member may be arranged to cooperate with a drive shaft for converting a rotational input motion into a reciprocating output motion of the movable cutter blade with respect to the stationary blade. To this end, the transmitting member basically needs to be coupled to the movable cutter blade. Consequently, a step S18 may follow which may include feeding the transmitting member to the pre-assembled movable cutter blade which is arranged in a guide slot of the stationary blade. It is particularly preferred that a feeding direction of the transmitting member is different from an insertion direction of the movable cutter blade, particularly perpendicular thereto. At a further step S20, the transmitting member may be bonded, particularly laser welded, to the movable cutter blade. The step S20 may involve locking or securing the movable cutter blade in a non-releasable manner at the stationary blade.

Figure 23:
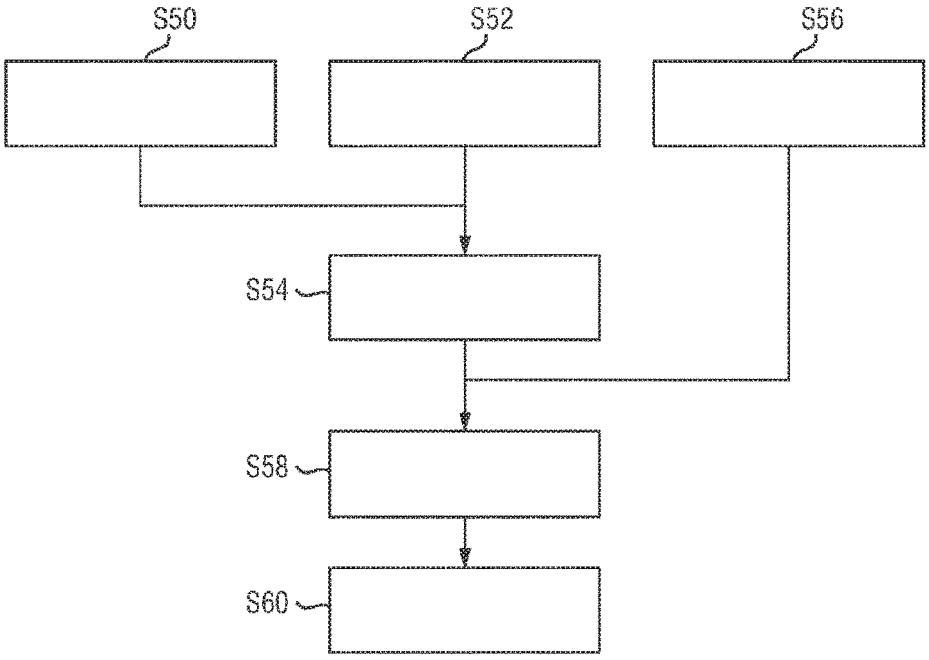
FIG. 23 shows yet another illustrative block diagram representing several steps of an embodiment of an exemplary blade set manufacturing method in accordance with several aspects of the present disclosure.

With further reference to FIG. 23, an alternative exemplary manufacturing method for a blade set is illustrated and further described. A step S50 may involve providing a stationary blade. A further step S52 may involve providing a movable cutter blade. At a further step S54, the movable cutter blade may be inserted into a guide slot of the stationary blade. A further step S56 may be provided which includes providing a transmitting member for the movable cutter blade. A step S58 may follow which may include feeding the transmitting member 70 to the movable cutter blade which is arranged in the guide slot at the stationary blade. As with the embodiment of the manufacturing method illustrated in FIG. 22, also the step S58 may involve feeding the transmitting member in a feeding direction that is different from an insertion direction for the movable cutter blade.

A further step S60 may follow which may include connecting the transmitting member and the movable cutter blade. The step S60 may particularly comprise plugging the transmitting member to the stationary blade. It is particularly preferred that the transmitting member is not fixedly attached at the movable cutter blade at the step S60. However, the step S60 may include snapping-in the transmitting member at the stationary blade. To this end, the transmitting member may comprise at least one snap-on element, for instance a snap-on hook. The step S60 may further comprise engaging a drivable drive engagement member at the movable cutter blade with a respective driving member of the transmitting member.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A blade set for a hair cutting appliance, said blade set being arranged to be moved through hair in a moving direction to cut hair, said blade set comprising:

a stationary blade comprising:

a first wall portion arranged to serve as a skin facing wall when in operation, a second wall portion at least partially offset from the first wall portion, wherein the first wall portion and the second wall portion define therebetween a guide slot, and at least one toothed leading edge jointly formed by the first wall portion and the second wall portion, and a movable cutter blade comprising:

at least one toothed leading edge, said movable cutter blade laterally inserted into the guide slot and movably arranged therein, wherein upon relative motion of the movable cutter blade with respect to the stationary blade, the at least one toothed leading edge of the movable cutter blade cooperates with corresponding teeth of the stationary blade to enable cutting of hair caught therebetween in a cutting action, and a transmitting member configured to actuate the movable cutter blade relative to the stationary blade, wherein the transmitting member is fed to the stationary blade in a feed direction that is different from an insertion direction of the movable cutter blade, wherein the transmitting member is coupled to a main portion of the movable cutter blade, such that the movable cutter blade is undetachably retained at the stationary blade, and wherein a main sheet metal portion of the movable cutter blade, and the transmitting member jointly embrace a laterally extending retaining tab of the second wall portion of the stationary blade.

2. The blade set as claimed in claim 1, wherein the movable cutter blade is inserted into the stationary blade in a lateral direction (Y), wherein the transmitting member is fed in a vertical direction (Z) that is basically perpendicular to the lateral direction (Y), and wherein the movable cutter blade is mounted at the stationary blade in a laterally movable manner.

3. The blade set as claimed in claim 1, wherein the movable cutter blade and the transmitting member jointly define a securing opening, and wherein the retaining tab of the stationary blade is located in the securing opening.

4. The blade set as claimed in claim 1, wherein the retaining tab of the stationary blade defines a lateral limit stop for the movable cutter blade.

5. The blade set as claimed in claim 1, wherein at least one guide element of the second wall portion of the stationary blade, defines a longitudinal position of the movable cutter blade with respect to the stationary blade.

6. The blade set as claimed in claim 1, wherein the movable cutter blade and the transmitting member are one of: bonded and positively locked, to each other in the mounted state.

7. The blade set as claimed in claim 1, wherein the stationary blade is an integrally formed metal-plastic composite stationary blade, wherein the first wall portion is at least partially made from metal material, wherein the second wall portion is at least partially made from plastic material, wherein the at least one toothed leading edge of the stationary blade comprises a plurality of teeth, and wherein the first wall portion and the second wall portion are connected at a frontal end of the at least one leading edge, thereby forming tips of the teeth.

8. The blade set as claimed in claim 1, wherein the stationary blade comprises a sheet metal insert component, and a plastic component bonded to the sheet metal insert component, wherein at least a central portion of the first wall portion is formed by the sheet metal metal component, wherein the plastic component and the sheet metal insert component (40) form an integrally formed part selected from the group consisting of insert-molded part, outsert-molded part and overmolded part.

9. An electrically powered hair cutting appliance, comprising a cutting head that is fitted with a blade set as claimed in claim 1.

10. A method of manufacturing a blade set for a hair cutting appliance, comprising the steps of:

providing a stationary blade comprising:

at least one toothed leading edge, a first wall portion, and a second wall portion, wherein the second wall portion is at least partially offset from the first wall portion, such that the first wall portion and the second wall portion define therebetween a guide slot;

providing a movable cutter blade comprising at least one toothed leading edge;

inserting the movable cutter blade into the guide slot of the stationary blade; by passing the movable cutting blade through a lateral opening of the stationary blade;

providing a transmitting member to actuate the movable cutter blade for relative motion with respect to the stationary blade, feeding the transmitting member to the stationary blade in a feed direction that is different from an insertion direction of the movable cutter blade;

connecting the transmitting member to a main portion of movable cutter blade wherein the movable cutter blade is retained at the stationary blade, wherein the movable cutter blade and the transmitting member jointly embrace a laterally extending retaining tab, of the second wall portion of the stationary blade.

11. The method as claimed in claim 10, wherein the step of inserting the movable cutter blade comprises:

inserting the movable cutter blade in a lateral direction (Y), and wherein the step of feeding the transmitting member comprises feeding the transmitting member in a vertical direction (Z) that is substantially perpendicular to the lateral direction (Y).

12. The method as claimed in claim 10, wherein the movable cutter blade is connected at the stationary blade in a laterally movable manner, and wherein the movable cutter blade is secured against disengagement in the vertical direction (Z).

13. The method as claimed in claim 10, wherein the step of connecting the movable cutter blade to the stationary blade further comprises:

engaging an engagement portion at the movable cutter blade and locking the transmitting member and the movable cutter blade in a positive-locking manner.

14. The method as claimed in claim 10, wherein the step of connecting the movable cutter blade to the stationary blade further comprises:

bonding the transmitting member to the movable cutter blade.

15. The method as claimed in claim 14, wherein the step of bonding further comprises:

laterally moving the movable cutter blade with respect to the stationary blade such that a lateral end portion of the movable cutter blade is accessible for a bonding device, aligning the transmitting member and the movable cutter blade) such that respective bonding spots overlap each other, and bonding the transmitting member to the movable cutter blade.

16. The blade set as claimed in claim 1, wherein the transmitting member is configured to engage a drive mechanism.

* * * * *